United States Patent [19]

Saitoh et al.

[11] Patent Number: 4,705,733

[45] Date of Patent: Nov. 10, 1987

[54] MEMBER HAVING LIGHT RECEIVING LAYER AND SUBSTRATE WITH OVERLAPPING SUBPROJECTIONS

[75] Inventors: Keishi Saitoh, Ibaraki; Masahiro Kanai, Tokyo; Tetsuo Sueda, Chofu; Teruo Misumi, Kawasaki; Yoshio Tsuezuki, Toride; Kyosuke Ogawa, Tokyo, all of Japan

[73] Assignee: Canon Kabushiki Kaisha, Tokyo, Japan

[21] Appl. No.: 725,751

[22] Filed: Apr. 22, 1985

[30] Foreign Application Priority Data

| | | | |
|---|---|---|---|
| Apr. 24, 1984 | [JP] | Japan | 59-82606 |
| Apr. 25, 1984 | [JP] | Japan | 59-83284 |
| Apr. 26, 1984 | [JP] | Japan | 59-84703 |

[51] Int. Cl.[4] ..... G03G 5/085

[52] U.S. Cl. ..... 430/57; 430/69; 430/84

[58] Field of Search ..... 430/56, 57, 58, 65, 430/69, 84, 127

[56] References Cited

U.S. PATENT DOCUMENTS

| | | | |
|---|---|---|---|
| 4,359,514 | 11/1982 | Shimizu et al. | 430/65 |
| 4,492,745 | 1/1985 | Mimura et al. | 430/67 |
| 4,514,483 | 4/1985 | Matsuura et al. | 430/84 |

FOREIGN PATENT DOCUMENTS

| | | | |
|---|---|---|---|
| 2733187 | 1/1978 | Fed. Rep. of Germany | 430/65 |
| 56-150754 | 11/1981 | Japan | 430/65 |

*Primary Examiner*—John L. Goodrow

*Attorney, Agent, or Firm*—Fitzpatrick, Cella, Harper & Scinto

[57] ABSTRACT

A substrate for light-receiving members has a large number of protruding portions on a surface thereof, each of said protruding portions having at a predetermined cut position a sectional shape comprising a main projection and a subprojection, the main projection and the subprojection overlapping each other.

64 Claims, 32 Drawing Figures

Fig.6(A)
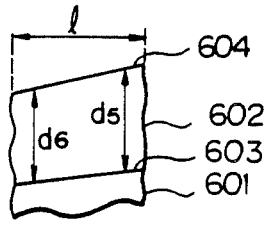
Fig.6(B)
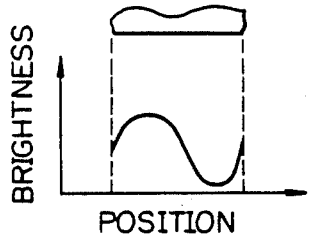
Fig.6(C)
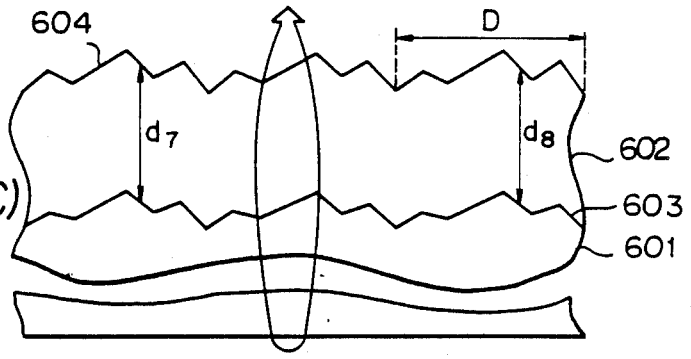
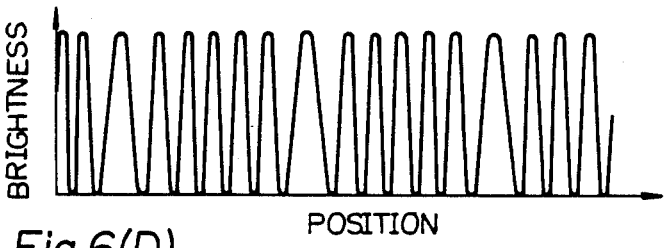
Fig.6(D)

Fig.11(A)
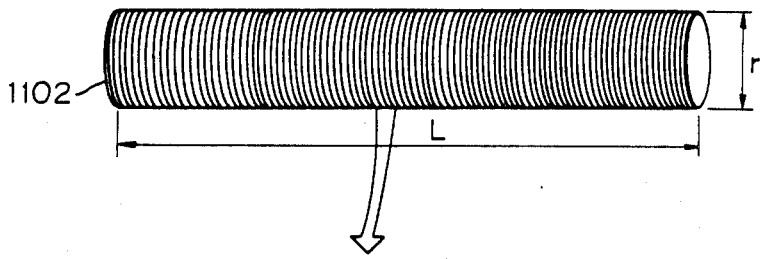
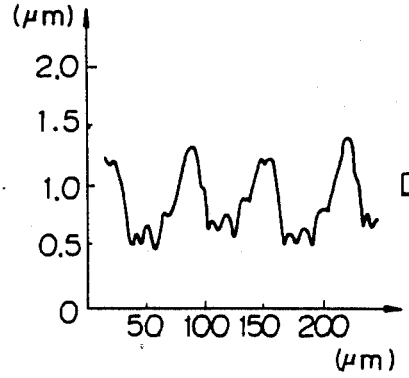
Fig.11(B)
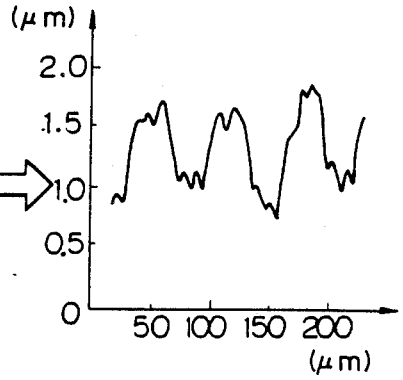
Fig.11(C)

MEMBER HAVING LIGHT RECEIVING LAYER AND SUBSTRATE WITH OVERLAPPING SUBPROJECTIONS

CROSS REFERENCE TO RELATED APPLICATIONS

This application contains subject matter related to commonly assigned, copending application Ser. Nos. 697,141; 699,868; 705,516; 709,888; 720,011; 740,901; 786,970; 717,821; 719,980; 726,768; 739,867; 740,714; 741,300; 753,048; 753,011 and 752,920.

BACKGROUND OF THE INVENTION

1. Field of the Invention

This invention relates to a light receiving-member having sensitivity to electromagnetic waves such as light (herein used in a broad sense, including ultraviolet rays, visible light, infrared rays, X-rays and gamma-rays). More particularly, it pertains to a light-receiving member suitable for using a coherent light such as laser beam.

2. Description of the Prior Art

As the method for recording a digital image information as an image, there have been well known the methods in which an electrostatic latent image is formed by scanning optically a light-receiving member with a laser beam modulated corresponding to a digital image information, then said latent image is developed, followed by processing such as transfer or fixing, if desired, to record an image. Among them, in the image forming method employing electrophotography, image recording has been generally practiced with the use of a small size and inexpensive He-Ne laser or a semiconductor laser (generally having an emitted wavelength of 650–820 nm)

In particular, as the light-receiving member for electrophotography which is suitable when using a semiconductor laser, an amorphous material containing silicon atoms (hereinafter written briefly as "A-Si") as disclosed in Japanese Laid-open Patent Application Nos. 86341/1979 and 83746/1981 is attracting attention for its high Vickers hardness and non-polluting properties in social aspect in addition to the advantage of being by far superior in matching in its photosensitive region as compared with other kinds of light-receiving members.

However, when the photosensitive layer is made of a single A-Si layer, for ensuring dark resistance of $10^{12}$ ohm.cm or higher required for electrophotography while maintaining high photosensitivity, it is necessary to incorporate structurally hydrogen atoms or halogen atoms or boron atoms in addition thereto in controlled form within specific ranges of amounts. Accordingly, control of layer formation is required to be performed severely, whereby tolerance in designing of a light-receiving member is considerably limited.

As attempts to enlarge this tolerance in designing, namely to enable effective utilization of its high photosensitivity in spite of somewhat lower dark resistance, there have been proposed a light-receiving layer with a multi-layer structure of two or more laminated layers with different conductivity characteristics with formation of a depletion layer within the light-receiving layer, as disclosed in Japanese Laid-open Patent Application Nos. 121743/1979, 4053/1982 and 4172/1982, or a light receiving member with a multi-layer structure in which a barrier layer is provided between the substrate and the photosensitive layer and/or on the upper surface of the photosensitive layer, thereby enhancing apparent dark resistance of the light-receiving layer as a whole, as disclosed in Japanese Laid-open Patent Application Nos. 52178/1982, 52179/1982, 52180/1982, 58159/1982, 58160/1982 and 58161/1982.

According to such proposals, A-Si type light-receiving members have been greatly advanced in tolerance in designing of commercialization thereof or easiness in management of its production and productivity, and the speed of development toward commercialization is now further accelerated.

When carrying out laser recording by use of such a light-receiving member having a light receiving layer of a multi-layer structure, due to irregularity in thickness of respective layers, and also because of the laser beam which is an coherent monochromatic light, it is possible that the respective reflected lights reflected from the free surface on the laser irradiation side of the light-receiving layer and the layer interface between the respective layers constituting the light-receiving layer and between the substrate and the light-receiving layer (hereinafter "interface" is used to mean comprehensively both the free surface and the layer interface) may undergo interference.

Such an interference phenomenon results in the so-called interference fringe pattern in the visible image formed and causes a poor image. In particular, in the case of forming a halftone image with high gradation, bad appearance of the image will become marked.

Moreover, as the wavelength region of the semiconductor laser beam is shifted toward longer wavelength, absorption of said laser beam in the photosensitive layer becomes reduced, whereby the above interference phenomenon becomes more marked.

This point is explained by referring to the drawings.

FIG. 1 shows a light $I_0$ entering a certain layer constituting the light-receiving layer of a light-receiving member, a reflected light $R_1$ from the upper interface 102 and a reflected light $R_2$ reflected from the lower interface 101.

Now, the average layer thickness of the layer is defined as d, its refractive index as n and the wavelength of the light as $\lambda$, and when the layer thickness of a certain layer is ununiform gently with a layer thickness difference of $\lambda/2n$ or more, changes in absorbed light quantity and transmitted light quantity occur depending on to which condition of $2nd=m\lambda$ (m is an integer, reflected lights are strengthened with each other) and $2nd=(m+\frac{1}{2})\lambda$ (m is an integer, reflected lights are weakened with each other) the reflected lights $R_1$ and $R_2$ conform.

In the light-receiving member of a multi-layer structure, the interference effect as shown in FIG. 1 occurs at each layer, and there ensues a synergistic deleterious influence through respective interferences as shown in FIG. 2. For this reason, the interference fringe corresponding to said interference fringe pattern appears on the visible image transferred and fixed on the transfer member to cause bad images.

As the method for cancelling such an inconvenience, it has been proposed to subject the surface of the substrate to diamond cutting to provide unevenness of ±500 Å–±10,000 Å, thereby forming a light scattering surface (as disclosed in Japanese Laid-open Patent Application No. 162975/1983); to provide a light absorbing layer by subjecting the aluminum substrate surface to black Alumite treatment or dispersing carbon, color pigment or dye in a resin (as disclosed in Japanese Laid-open Patent Application No. 165845/1982); and to provide a light scattering reflection preventive layer on the substrate surface by subjecting the aluminum substrate surface to satin-like Alumite treatment or by providing a sandy fine unevenness by sand blast (as disclosed in Japanese Laid-open Patent Application No. 16554/1982).

However, according to these methods of the prior art, the interference fringe pattern appearing on the image could not completely be cancelled.

For example, because only a large number of unevenness with specific sized are formed on the substrate surface according to the first method, although prevention of appearance of interference fringe through light scattering is indeed effected, regular reflection light component yet exists. Therefore, in addition to remaining of the interference fringe by said regular reflection light, enlargement of irradiated spot occurs due to the light scattering effect on the surface of the substrate to be a cause for substantial lowering of resolution.

As for the second method, such a black Alumite treatment is not sufficient for complete absorption, but reflected light from the substrate surface remains. Also, there are involved various inconveniences. For example, in providing a resin layer containing a color pigment dispersed therein, a phenomenon of degassing from the resin layer occurs during formation of the A-Si photosensitive layer to markedly lower the layer quality of the photosensitive layer formed, and the resin layer suffers from a damage by the plasma during formation of A-Si photosensitive layer to be deteriorated in its inherent absorbing function. Beside, worsening of the surface state deleteriously affects subsequent formation of the A-Si photosensitive layer.

In the case of the third method of irregularly roughening the substrate surface, as shown in FIG. 3, for example, the incident light $I_0$ is partly reflected from the surface of the light-receiving layer 302 to become a reflected light $R_1$, with the remainder progressing internally through the light-receiving layer 302 to become a transmitted light $I_1$. The transmitted light $I_1$ is partly scattered on the surface of the substrate 301 to become scattered lights $K_1$, $K_2$, $K_3 \ldots K_n$, with the remainder being regularly reflected to become a reflected light $R_2$, a part of which goes outside as an emitted light $R_3$. Thus, since the reflected light $R_1$ and the emitted light $R_3$ which is an interferable component remain, it is not yet possible to extinguish the interference fringe pattern.

On the other hand, if diffusibility of the surface of the substrate 301 is increased in order to prevent multiple reflections within the light-receiving layer 302 through prevention of interference, light will be diffused within the light-receiving layer 302 to cause halation, whereby resolution is disadvantageously lowered.

Particularly, in a light-receiving member of a multi-layer structure, as shown in FIG. 4, even if the surface of the substrate 401 may be irregularly roughened, the reflected light $R_2$ from the first layer 402, the reflected light $R_1$ from the second layer 403 and the regularly reflected light $R_3$ from the surface of the substrate 401 are interfered with each other to form an interference fringe pattern depending on the respective layer thicknesses of the light receiving member. Accordingly, in a light receiving member of a multi-layer structure, it was impossible to completely prevent appearance of interference fringes by irregularly roughening the surface of the substrate 401.

In the case of irregularly roughening the substrate surface according to the method such as sand blasting, etc., the roughness will vary so much from lot to lot, and there is also nonuniformity in roughness even in the same lot, and therefore production control could be done with inconvenience. In addition, relatively large projections with random distributions are frequently formed, hence causing local breakdown of the light-receiving layer during charging treatment.

On the other hand, in the case of simply roughening the surface of the substrate 501 regularly, as shown in FIG. 5, since the light-receiving layer 502 is deposited along the uneven shape of the surface of the substrate 501, the slanted plane of the unevenness of the substrate 501 becomes parallel to the slanted plane of the unevenness of the light-receiving layer 502.

Accordingly, for the incident light on that portion, $2nd_1=m\lambda$ or $2nd_1=(m+\frac{1}{2})\lambda$ holds, to make it a light portion or a dark portion. Also, in the light receiving layer as a whole, since there is nonuniformity in which the maximum difference among the layer thicknesses $d_1$, $d_2$, $d_3$ and $d_4$ of the light receiving layer is $\lambda/2n$ or more, there appears a light and dark fringe pattern.

Thus, it is impossible to completely extinguish the interference fringe pattern by only roughening regularly the surface of the substrate 501.

Also, in the case of depositing a light receiving layer of a multi-layer structure on the substrate, the surface of which is regularly roughened, in addition to the interference between the regularly reflected light from the substrate surface and the reflected light from the light receiving layer surface as explained for light-receiving member of a single layer structure in FIG. 3, interferences by the reflected lights from the interfaces between the respective layers participate to make the extent of appearance of interference fringe pattern more complicated than in the case of the light-receiving member of a single layer structure.

SUMMARY OF THE INVENTION

An object of the present invention is to provide a novel substrate for use in a light-receiving member sensitive to light, which has cancelled the drawbacks as described above, and a light-receiving member having said substrate.

Another object of the present invention is to provide a substrate for use in a light-receiving member which is suitable for image formation by use of a coherent monochromatic light and also easy in production management, and a light-receiving member having said substrate.

Still another object of the present invention is to provide a light-receiving member which can cancel the interference fringe pattern appearing during image formation and appearance of speckles on reversal developing at the same time and completely.

Further, another object of the present invention is to provide a light-receiving member which can perform digital image recording utilizing electrophotography, above all digital image recording having a halftone information, clearly and at high resolution with high quality.

Still another object of the present invention is to provide a light-receiving member having high photosensitivity, high SN ratio characteristic and good electrical contact with a substrate.

According to the present invention, there is provided a substrate for light-receiving members, having a large number of protruding portions on a surface thereof, each of said protruding portions having at a predetermined cut position a sectional shape comprising a main projection and a subprojection, the main projection and the subprojection overlapping each other.

BRIEF DESCRIPTION OF THE DRAWINGS

FIG. 6 is a schematic illustration of the principle of no appearance of interference fringe in the case of non-parallel interfaces between respective layers of a light-receiving member;

FIG. 11 is a schematic illustration of the surface condition of the aluminum substrate as a preferred embodiment of the present invention;

DETAILED DESCRIPTION OF THE PREFERRED EMBODIMENTS

Referring now to the accompanying drawings, the present invention is to be described in detail below.

FIG. 6 is a schematic illustration for explanation of the basic principle of the present invention.

In the present invention, on a substrate (not shown) having a fine uneven shape smaller than the resolution required for the device, a light-receiving layer of a multi-layer constitution is provided along the uneven slanted plane, with the thickness of the second layer 602 being continuously changed from $d_5$ to $d_6$, as shown enlarged in a part of FIG. 6, and therefore the interface 603 and the interface 604 have respective gradients. Accordingly, the coherent light incident on this minute portion (short range region) l [indicated schematically in FIG. 6(C), and its enlarged view shown in FIG. 6(A)] undergoes interference at said minute portion l to form a minute interference fringe pattern.

Figure 1:
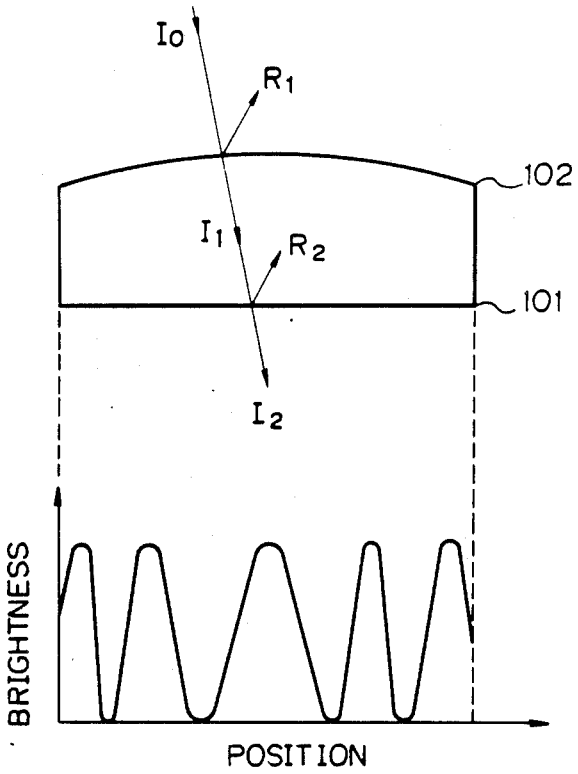
FIG. 1 is a schematic illustration of interference fringe in general.
Figure 2:
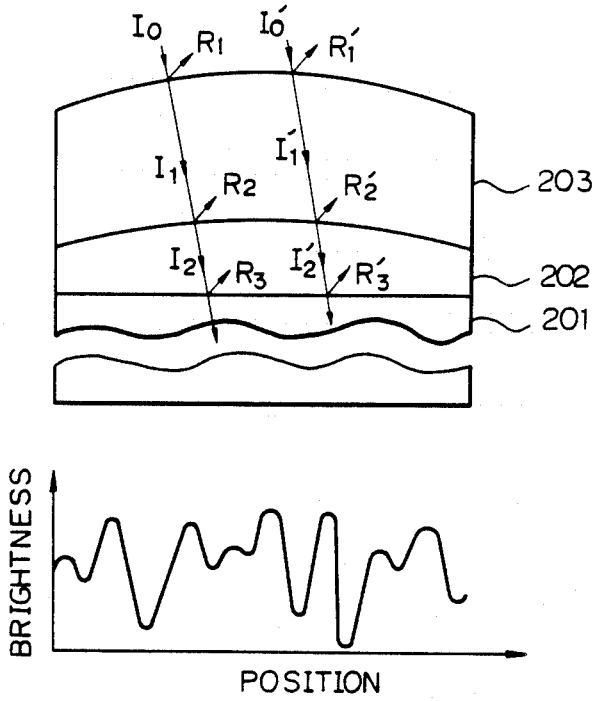
FIG. 2 is a schmatic illustration of interference fringe in the case of a multi-layer light-receiving member.
Figure 3:
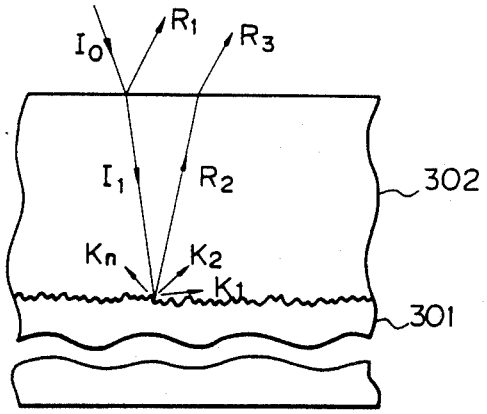
FIG. 3 is schematic illustration of interference fringe by scattered light.
Figure 4:
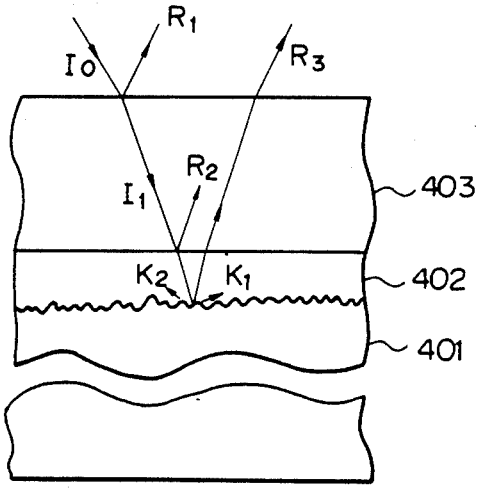
FIG. 4 is a schematic illustration of interference fringe by scattered light in the case of a multi-layer light-receiving member.
Figure 5:
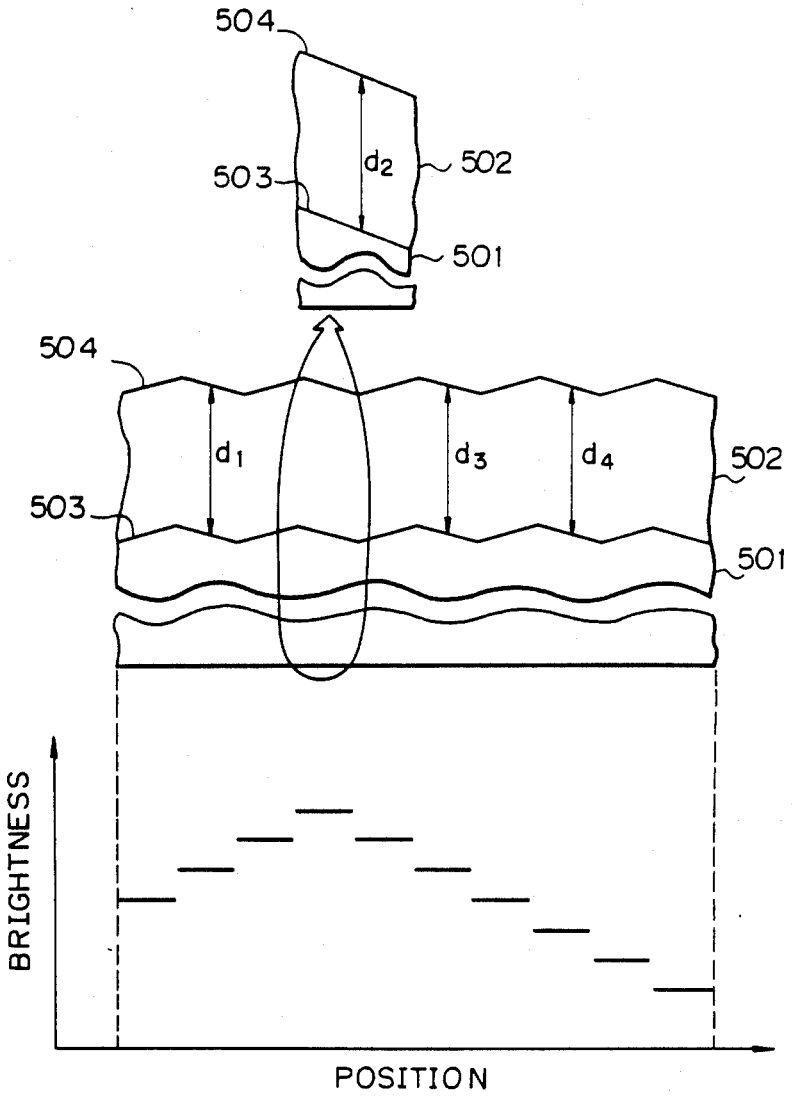
FIG. 5 is a schematic illustration of interference fringe in the case where the interfaces of respective layers of a light-receiving member are parallel to each other.
Figure 7A:
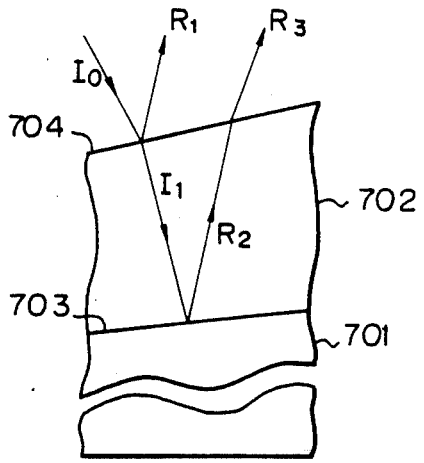
FIG. 7 is a schematic illustration of comparison of the reflected light intensity between the case of parallel interfaces and non-parallel interfaces between the respective layers of a light-receiving member.
Figure 7B:
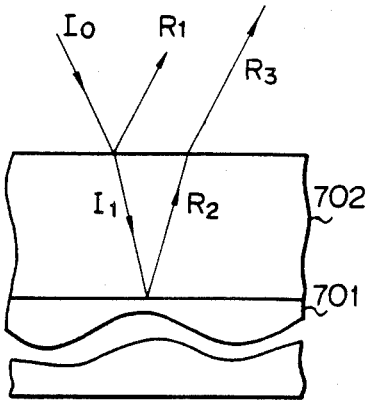

Also, as shown in FIG. 7, when the interface 703 between the first layer 701 and the second layer 702 and the free surface 704 of the second layer 702 are non-parallel to each other, the reflected light $R_1$ and the emitted light $R_3$ are different in direction of progress from each other relative to the incident light $I_0$ as shown in FIG. 7(A), and therefore the degree of interference will be reduced as compared with the case [FIG. 7(B)] when the interfaces 703 and 704 are parallel to each other.

Figure 7C:
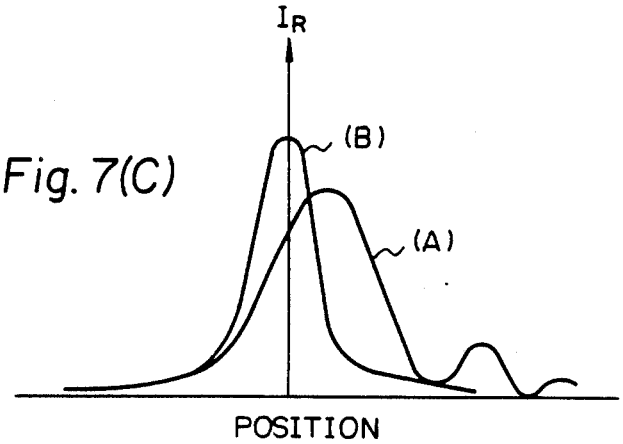

Accordingly, as shown in FIG. 7(C), as compared with the case "(B)" where a pair of the interfaces are in parallel relation, the difference in lightness and darkness in the interference fringe pattern becomes negligibly small even if interfered, if any, in the non-parallel case "(A)".

The same is the case, as shown in FIG. 6, even when the layer thickness of the layer 602 may be microscopically ununiform ($d_7 \neq d_8$), and therefore the incident light quantity becomes uniform all over the layer region [see FIG. 6(D)].

Figure 8:
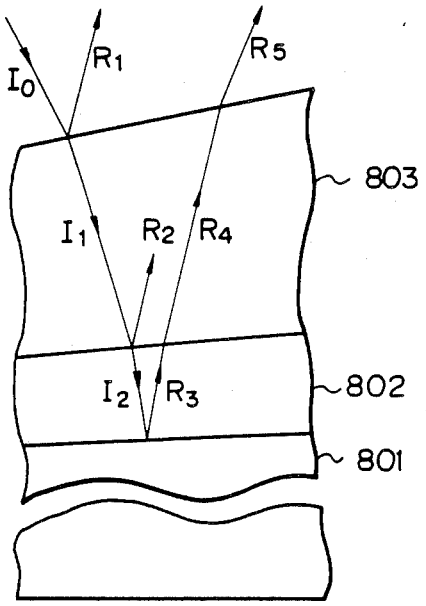
FIG. 8 is a schematic illustration of no appearance of interference fringe in the case of non-parallel interfaces between respective layers even by extending to two layers.

To describe about the effect of the present invention when coherent light is transmitted from the irradiation side to the first layer in the case of a light-receiving layer of a multi-layer structure, reflected lights $R_1$, $R_2$, $R_3$, $R_4$ and $R_5$ exist in connection with the incident light $I_0$ as shown in FIG. 8. Accordingly, at the respective layers, the same phenomenon as described with reference to FIG. 7 occurs.

Moreover, the interfaces between the respective layers at a minute portion function as a kind of slit, at which diffraction phenomenon will occur.

Accordingly, interference at respective layers appears as the effect of the product of interference due to difference in layer thickness and the interference due to difraction at the respective layer interfaces.

Therefore, when considered for the light-receiving layer as a whole, interference occurs as a synergetic effect of the respective layers and, according to the present invention, appearance of interference can further be prevented as the number of layers constituting the light-receiving layer is increased.

The interference fringe occurring within the minute portion cannot appear on the image, because the size of the minute portion is smaller than the spot size of the irradiated light, namely smaller than the resolution limit. Further, even if appeared on the image, there is no problem at all, since it is less than resolving ability of the eyes.

In the present invention, the slanted plane of unevenness should desirably be mirror finished in order to direct the reflected light assuredly in one direction.

The size l (one cycle of uneven shape) of the minute portion suitable for the present invention is $l<L$, wherein L is the spot size of the irradiation light.

By such a designing, the diffraction effect at the ends of minute portions can positively be utilized, whereby appearance of interference fringe pattern can further be suppressed.

Further, in order to accomplish more effectively the objects of the present invention, the layer thickness difference ($d_5-d_6$) at the minute portion l should desirably be as follows:

$d_5-d_6 \geqq \lambda/2n$ (where $\lambda$ is the wavelength of the irradiation light and n is the refractive index of the second layer 602) (See FIG. 6).

In the present invention, within the layer thickness of the minute portion l (hereinafter called as "minute column") in the light-receiving layer of a multi-layer structure, the layer thicknesses of the respective layers are controlled so that at least two interfaces between layers may be in non-parallel relationship, and, provided that this condition is satisfied, any other pair of interfaces between layers may be in parallel relationship within said minute column.

However, it is desirable that the layers forming parallel interfaces should be formed to have uniform layer thicknesses so that the difference in layer thickness at any two positions may be not more than:

$\lambda/2n$ (n: refractive index of the layer).

For formation of the respective layers of the first layer and the second layer constituting the light-receiving layer, in order to accomplish more effectively and easily the objects of the present invention, the plasma chemical vapor deposition method (PCVD method), the optical CVD method and thermal CVD method can be employed, because the layer thickness can accurately be controlled on the optical level thereby.

As the method for working the substrate to accomplish the objects of the present invention, it is possible to utilize the chemical methods such as chemical etching, electric plating, etc., the physical methods such as vapor deposition, sputtering etc. and the mechanical methods such as lathe working, etc. However, the mechanical working method by lathe, etc. are preferred for easy production management. For example, a substrate may be worked with a lathe by fixing a bite having a V-shaped cutting blade at a predetermined position on a cutting working machine such as milling machine, lathe, etc, and cut working accurately the substrate surface by, for example, moving regularly in a certain direction while rotating a cylindrical substrate according to a program previously designed as desired, thereby forming to a desired unevenness shape, pitch and depth. The linear projection produced by the unevenness formed by such a cutting working has a spiral structure with the center axis of the cylindrical substrate as its center. The spiral structure of the projection may be made into a multiple spiral structure such as double or triple structure or a crossed spiral structure.

Alternatively, a straight line structure along the center axis may also be introduced in addition to the spiral structure.

Each of the protruding portions formed on the surface of the substrate is preferred to have the same shape as the first order approximation at a predetermined section in order to make the working control easy.

At a predetermined cut position, each of the protruding portions has a sectional shape comprising a main projection (main peak) and a subprojection (subpeak), the main projection and the subprojection overlapping each other.

Figure 9A:
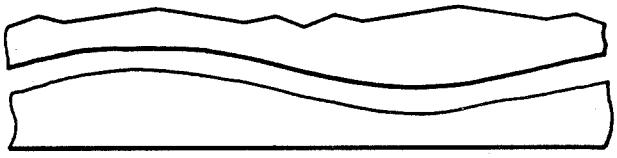
FIG. 9(A) and (B) each is a schematic illustration of the surface condition of a typical substrate in the present invention.
Figure 9B:
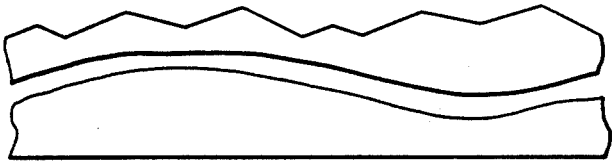

Preferably, the above-mentioned protruding portions may be arranged regularly or periodically in order to enhance the effect of the invention. Further, the above-mentioned protruding portion, for further enhancing the effect of the invention and enhancing adhesion between the light-receiving layer and the substrate, may preferably have multiple subprojections which may overlap each other. In addition to these, for scattering with good efficiency the incident light in one direction, the above-mentioned protruding portion may preferably be united in symmetrically [FIG. 9(A)] or asymmetrically [FIG. 9(B)] with the main projection at its center. However, for enhancing the degree of freedom in management of substrate working, it is preferred that both exist mixed in the substrate.

In the present invention, the respective dimensions of the unevenness provided on the substrate surface under managed condition are set so as to accomplish effectively the objects of the present invention in view of the following points.

More specifically, in the first place, for example, when employing A-Si layer as one of the layers constituting the light-receiving layer, the A-Si layer is sensitive to the structure of the surface on which the layer formation is effected, and the layer quality will be changed greatly depending on the surface condition.

Accordingly, it is desirable to set dimensions of the unevenness to be provided on the substrate surface so that lowering in layer quality of the A-Si layer may not be brought about.

Secondly, when there is extreme unevenness on the free surface of the light-receiving layer, cleaning cannot frequently be performed completely in cleaning step after image formation.

Further, in case of practicing blade cleaning, there is involved the problem that the blade will be damaged more earlier.

As the result of investigations of the problems is layer deposition as described above, problems in process of electrophotography and the conditions for prevention of interference fringe pattern, it has been found that the pitch at the recessed portion on the substrate surface should preferably be 500 μm to 0.3 μm, more preferably 200 μm to 1 μm, most preferably 50 μm to 5 μm.

It is also desirable that the maximum depth of the recessed portion should preferably be made 0.1 μm to 5 μm, more preferably 0.3 μm to 3 μm, most preferably 0.6 μm to 2 μm. When the pitch and the maximum depth of the recessed portions on the substrate surface are within the ranges as specified above, the gradient of the slanted plane at the recessed portion (or linear projection) may preferably be 1° to 20°, more preferably 3° to 15°, most preferably 4° to 10°.

On the other hand, the maximum of the difference in the layer thickness based on such an uniformness in layer thickness of the respective layers formed on such a substrate should preferably be made 0.1 μm to 2 μm within the same pitch, more preferably 0.1 μm to 1.5 μm, most preferably 0.2 μm to 1 μm.

Referring now to a preferred embodiment, the light-receiving member of the present invention having a multi-layer constitution is to be described.

Figure 10:
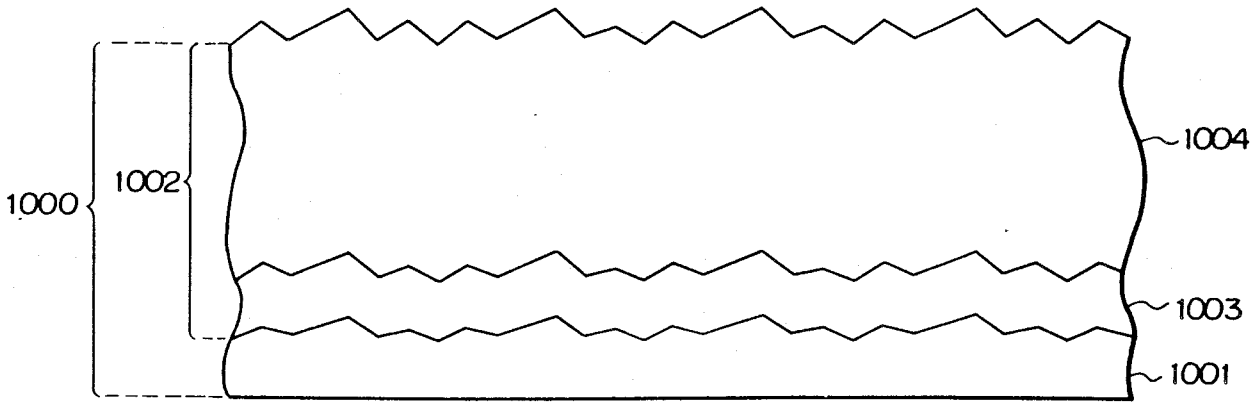
FIG. 10 and FIG. 29 each is a schematic illustration of a light-receiving member.

The light-receiving member 1000 shown in FIG. 10 has a light-receiving layer 1002 on a substrate 1001 which is subjected to surface cutting working so as to achieve the objects of the invention, said light-receiving layer 1002 being constituted of a charge injection preventive layer 1003 and a photosensitive layer 1004 from the side of the substrate 1001.

The substrate 1001 may be either electroconductive or insulating. As the electroconductive substrate, there may be mentioned metals such as NiCr, stainless steel, Al, Cr, Mo, Au, Nb, Ta, V, Ti, Pt, Pd etc. or alloys thereof.

As insulating substrates, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. At least one side surface of these substrates is preferably subjected to treatment for imparting electroconductivity, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3 + SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The substrate may be shaped in any form such as cylinders, belts, plates or others, and its form may be determined as desired. For example, when the light-receiving member 1000 in FIG. 10 is to be used as the light-receiving member for electrophotography, it may desirably be formed into an endless belt or a cylinder for use in continuous high speed copying. The substrate may have a thickness, which is conveniently determined so that the light-receiving member as desired may be formed. When the light-receiving member is required to have a flexibility, the substrate is made as thin as possible, so far as the function of a support can be exhibited. However, in such a case, the thickness is generally 10μ or more from the points of fabrication and handling of the substrate as well as its mechanical strength.

The charge injection preventive layer 1003 is provided for the purpose of preventing injection of charges into the photosensitive layer 1004 from the substrate 1001 side, thereby increasing apparent resistance.

The charge injection preventive layer 1003 is constituted of A-Si containing hydrogen atoms and/or halogen atoms (X) [hereinafter written as "A-Si(H,X)"] and also contains a substance (C) for controlling conductivity. As the substance (C) for controlling conductivity, there may be mentioned so called impurities in the field of semiconductors. In the present invention, there may be included p-type impurities giving p-type conductivity characteristics and n-type impurities giving n-type conductivity characteristics to Si. More specifically, there may be mentioned as p-type impurities atoms belonging to the group III of the periodic table (Group III atoms), such as B (boron), Al (aluminum), Ga (gallium), In (indium), Tl (thallium), etc., particularly preferably B and Ga.

As n-type impurities, there may be included the atoms belonging to the group V of the periodic table (Group V atoms), such as P (phosphorus), As (arsenic), Sb (antimony). Bi (bismuth), etc., particularly preferably P and As.

In the present invention, the content of the substance (C) for controlling conductivity contained in the charge injection preventing layer 1003 may be suitably be selected depending on the charge injection preventing characteristic required, or when the charge injection preventive layer 1003 is provided on the substrate 1001 directly contacted therewith, the organic relationship such as relation with the characteristic at the contacted interface with said substrate 1001. Also, the content of the substance (C) for controlling conductivity is selected suitably with due considerations of the relationships with characteristics of other layer regions provided in direct contact with the above charge injection preventive layer or the characteristics at the contacted interface with said other layer regions.

In the present invention, the content of the substance (C) for controlling conductivity contained in the charge injection preventive layer 1003 should preferably be 0.001 to $5\times10^4$ atomic ppm, more preferably 0.5 to $1\times10^4$ atomic ppm, most preferably 1 to $5\times10^3$ atomic ppm.

In the present invention, by making the content of the substance (C) in the charge injection preventive layer 1003 preferably 30 atomic ppm or more, more preferably 50 atomic ppm or more, most preferably 100 atomic ppm or more, the effect as described below can more markedly be obtained. For example, in the case when said substance (C) to be incorporated is a p-type impurity as mentioned above, migration of electrons injected from the substrate 1001 side into the photosensitive layer 1004 can be effectively inhibited when the free surface of the light-receiving layer 1002 is subjected to the charging treatment to ⊕ polarity. On the other hand, when the substance (C) to be incorporated is a n-type impurity as mentioned above, migration of positive holes injected from the substrate 1001 side into the photosensitive layer 1004 can be more effectively inhibited when the free surface of the light-receiving layer 1002 is subjected to the charging treatment to ⊖ polarity.

The charge injection preventive layer 1003 may have a thickness preferably of 30 Å to 10 μu, more preferably of 40 Å to 8 μu, most preferably of 50 Å to 5 μ.

The photosensitive layer 1004 is constituted of A-Si(H,X) and has both the charge generating function to generate photocarriers by irradiation with a laser beam and the charge transporting function to transport the charges.

The photosensitive layer 1004 may have a thickness preferably of 1 to 100μ, more preferably of 1 to 80μ, most preferably of 2 to 50μ.

The photosensitive layer 1004 may contain a substance for controlling conductivity of the other polarity than that of the substance for controlling conductivity contained in the charge injection preventive layer 1003, or when a substance for controlling conductivity is contained in the charge injection preventive layer 1003 in a large amount, a substance for controlling conductivity of the same polarity may be contained in the photosensitive layer 1004 in an amount by far smaller than that practically contained in the charge injection preventive layer 1003.

In such a case, the content of the substance for controlling conductivity contained in the above photosensitive layer 1004 can be determined adequately as desired depending on the polarity or the content of the substance contained in the charge injection preventive layer 1003, but it is preferably 0.001 to 1000 atomic ppm, more preferably 0.05 to 500 atomic ppm, most preferably 0.1 to 200 atomic ppm.

In the present invention, when the same kind of a substance for controlling conductivity is contained in the charge injection preventive layer 1003 and the photosensitive layer 1004, the content in the photosensitive layer 1004 should preferably be 30 atomic ppm or less.

In the present invention, the amount of hydrogen atoms (H) or the amount of halogen atoms (X) or the sum of the amounts of hydrogen atoms and halogen atoms (H+X) to be contained in the charge injection preventive layer 1003 and the photosensitive layer 1004 should preferably be 1 to 40 atomic %, more preferably 5 to 30 atomic %.

As halogen atoms (X), F, Cl, Br and I may be included and among them, F and Cl may preferably be employed.

In the light-receiving member shown in FIG. 10, a so called barrier layer comprising an electrically insulating material may be provided in place of the charge injection preventive layer 1003. Alternatively, it is also possible to use a barrier layer in combination with the charge injection preventive layer 1003.

As the material for forming the barrier layer, there may be included inorganic insulating materials such as $Al_2O_3$, $SiO_2$, $Si_3N_4$, etc. or organic insulating materials such as polycarbonate, etc.

In the light-receiving member as shown in FIG. 10, for the purpose of obtaining higher photosensitivity and dark resistance, and also for the purpose of improving adhesion between the substrate and the light-receiving layer, at least one kind of atoms selected from oxygen atoms, carbon atoms and nitrogen atoms can be contained in the light-receiving layer in either uniform or ununiform distribution state in the layer thickness direction. Such atoms (OCN) to be contained in the light-receiving layer may be contained therein throughout the whole layer region of the light-receiving layer or localized by being contained in a part of the layer region of the light-receiving layer.

The distribution concentration C (OCN) of the atoms (OCN) should desirably be uniform within the plane parallel to the surface of the substrate.

In the present invention, the layer region (OCN) where atoms (OCN) are contained is provided so as to occupy the whole layer region of the light-receiving layer when it is primarily intended to improve photosensitivity and dark resistance, while it is provided so as to occupy the end portion layer region on the substrate side of the light-receiving layer when it is primarily intended to strengthen adhesion between the substrate and the light-receiving layer.

In the former case, the content of atoms (OCN) contained in the layer region (OCN) should desirably be made relatively smaller in order to maintain high photosensitivity, while in the latter case relatively larger in order to ensure reinforcement of adhesion to the substrate.

In the present invention, the content of the atoms (OCN) to be contained in the layer region (OCN) provided in the light-receiving layer can be selected suitably in organic relationship with the characteristics required for the layer region (OCN) itself, or with the characteristic at the contacted interface with the substrate when the said layer region (OCN) is provided in direct contact with the substrate, etc.

When other layer regions are to be provided in direct contact with the layer region (OCN), the content of the atoms (OCN) may suitably be selected with due considerations about the characteristics of said other layer regions or the characteristics at the contacted interface with said other layer regions.

The amount of the atoms (OCN) contained in the layer region (OCN) may be determined as desired depending on the characteristics required for the light-receiving member to be formed, but it may preferably be 0.001 to 50 atomic %, more preferably 0.002 to 40 atomic %, most preferably 0.003 to 30 atomic %.

In the present invention, when the layer region (OCN) occupies the whole region of the light-receiving layer or, although not occupying the whole region, the proportion of the layer thickness $T_O$ of the layer region (OCN) occupied in the layer thickness T of the light-receiving layer is sufficiently large, the upper limit of the content of the atoms (OCN) contained in the layer region (OCN) should desirably be made sufficiently smaller than the value as specified above.

In the case of the present invention, when the proportion of the layer thickness $T_O$ of the layer region (OCN) occupied relative to the layer thickness T of the light-receiving layer is 2/5 or higher, the upper limit of the atoms (OCN) contained in the layer region (OCN) should desirably be made 30 atomic %, more preferably 20 atomic %, most preferably 10 atomic %.

According to a preferred embodiment of the present invention, it is desirable that the atoms (OCN) should be contained in at least the above first layer to be provided directly on the substrate. In short, by incorporating the atoms (OCN) at the end portion layer region on the substrate side in the light-receiving layer, it is possible to effect reinforcement of adhesion between the substrate and the light-receiving layer.

Further, in the case of nitrogen atoms, for example, under the co-presence with boron atoms, improvement of dark resistance and improvement of photosensitivity can further be ensured, and therefore they should preferably be contained in a desired amount in the light-receiving layer.

Plural kinds of these atoms (OCN) may also be contained in the light-receiving layer. For example, oxygen atoms may be contained in the charge injection preventive layer, nitrogen atoms in the photosensitive layer, or alternatively oxygen atoms and nitrogen atoms may be permitted to be co-present in the same layer region.

FIGS. 16 through 24 show typical examples of ununiform depth profiles in the layer thickness direction of the atoms (OCN) contained in the layer region (OCN) in the light-receiving member.

In FIGS. 16 through 24, the abscissa indicates the distribution concentration C of the atoms (OCN), and the ordinate the layer thickness of the layer region (OCN), $t_B$ showing the position of the end surface of the layer region on the substrate side, while $t_T$ shows the position of the end face of the layer region (OCN) opposite to the substrate side. Thus, layer formation of the layer region (OCN) containing the atoms (OCN) proceeds from the $t_B$ side toward the $t_T$ side.

Figure 16:
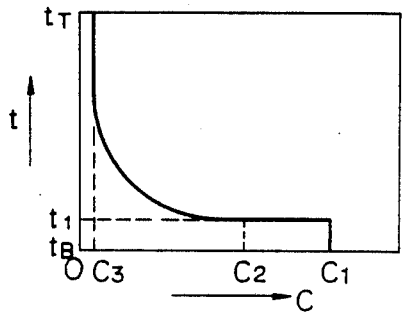
FIGS. 16 through 24 are each a schematic illustration of the depth profile of the atoms (OCN) in the layer region (OCN)

FIG. 16 shows a first typical embodiment of the depth profile in the layer thickness direction of the atoms (OCN) contained in the layer region (OCN).

In the embodiment shown in FIG. 16, from the interface position $t_B$ where the surface on which the layer region (OCN) containing the atoms (OCN) is formed contacts the surface of said layer region (OCN) to the position of $t_1$, the atoms (OCN) are contained in the layer region (OCN) to be formed while the distribution concentration of the atoms (OCN) taking a constant value of $C_1$, said distribution concentration being gradually continuously reduced from $C_2$ from the position $t_1$ to the interface position $t_T$, until at the interface position $t_T$, the distribution concentration C is made $C_3$.

Figure 17:
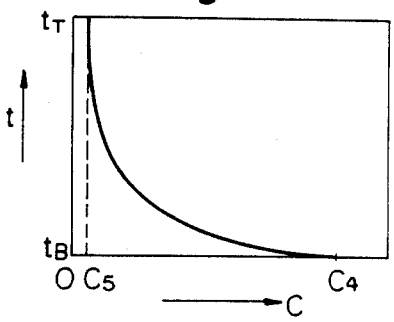

In the embodiment shown in FIG. 17, the distribution concentration C of the atoms (OCN) contained is reduced gradually continuously from the concentration $C_4$ from the position $t_B$ to the position $t_T$, at which it becomes the concentration $C_5$.

Figure 18:
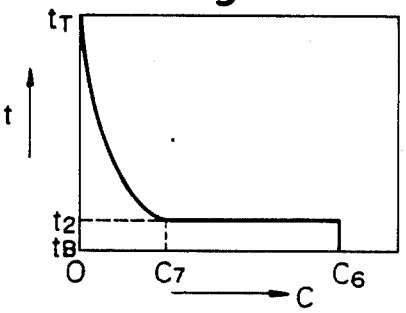

In the case of FIG. 18, from the position $t_B$ to the position $t_2$, the distribution concentration of the atoms (OCN) is made constantly at $C_6$, reduced gradually continuously from the concentration $C_7$ between the position $t_2$ and the position $t_T$, until at the position $t_T$, the distribution concentration C is made substantially zero (here substantially zero means the case of less than the detectable level).

Figure 19:
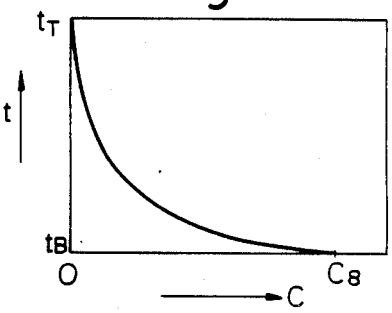

In the case of FIG. 19, the distribution concentration C of the atoms (OCN) is reduced gradually continuously from the concentration $C_8$ from the position $t_B$ up to the position $t_T$, to be made substantially zero at the position $t_T$.

Figure 20:
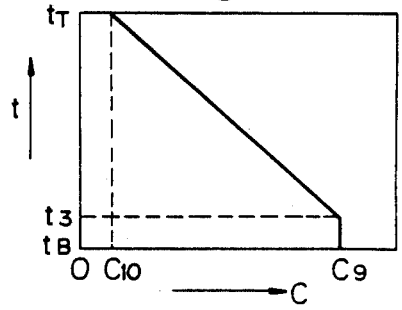

In the embodiment shown in FIG. 20, the distribution concentration C of the atoms (OCN) is made constantly $C_9$ between the position $t_B$ and the position $t_3$, and it is made the concentration $C_{10}$ at the position $t_T$. Between the position $t_3$ and the porition $t_T$, the distribution concentration C is reduced from the concentration $C_9$ to substantially zero as a first order function from the position $t_3$ to the position $t_T$.

Figure 21:
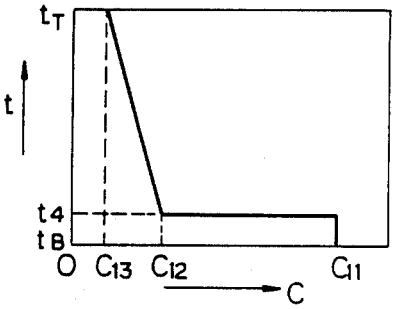

In the embodiment shown in FIG. 21, from the position $t_B$ to the position $t_4$, the distribution concentration C takes a constant value of $C_{11}$, while the distribution state is changed to a first order function in which the concentration is decreased from the concentration $C_{12}$ to the concentration $C_{13}$ from the position $t_4$ to the position $t_T$, and the concentration C is made substantially zero at the position $t_T$.

Figure 22:
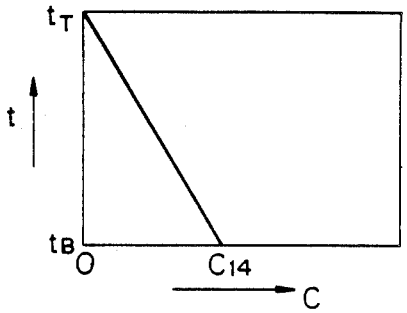

In the embodiment shown in FIG. 22, from the position $t_B$ to the position $t_T$, the distribution concentration C of the atoms (OCN) is reduced as a first order function from the concentration $C_{14}$ to substantially zero.

Figure 23:
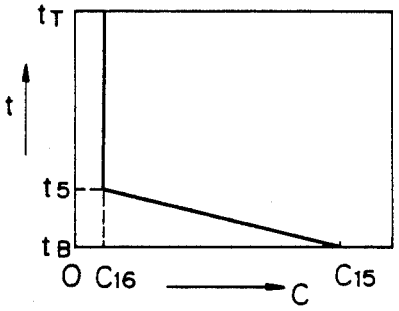

In FIG. 23, there is shown an embodiment, wherein from the position $t_B$ to the position $t_5$, the distribution concentration of the atoms (OCN) is reduced as a first order function from the concentration $C_{15}$ to $C_{16}$, and it is made constantly $C_{16}$ between the position $t_5$ and the position $t_T$.

Figure 24:
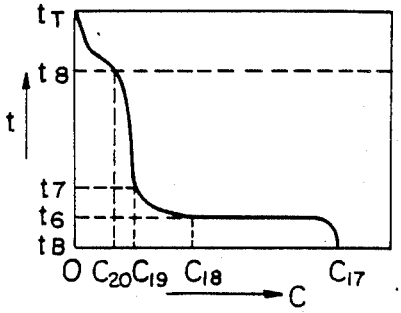

In the embodiment shown in FIG. 24, the distribution concentration C of the atoms (OCN) is $C_{17}$ at the position $t_B$, and, toward the position $t_6$, this $C_{17}$ is initially reduced gradually and then abruptly reduced near the position $t_6$, until it is made the concentration $C_{18}$ at the position $t_6$.

Between the position $t_6$ and the position $t_7$, the concentration is initially reduced abruptly and thereafter gently gradually reduced to become $C_{19}$ at the position $t_7$, and between the position $t_7$ and the position $t_8$, it is reduced very gradually to become $C_{20}$ at the position $t_8$. Between the position $t_8$ and the position $t_T$, the concentration is reduced from the concentration $C_{20}$ to substantially zero along a curve with a shape as shown in the Figure.

As described above about some typical examples of depth profiles in the layer thickness direction of the atoms (OCN) contained in the layer region (OCN) by referring to FIGS. 16 through 24, it is desirable in the present invention that, when the atoms (OCN) are to be contained ununiformly in the layer region (OCN), the atoms (OCN) should be distributed in the layer region (OCN) with higher concentration on the substrate side, while having a portion considerably depleted in concentration on the interface $t_T$ side as compared with the substrate side.

The layer region (OCN) containing atoms (OCN) should desirably be provided so as to have a localized region (B) containing the atoms (OCN) at a relatively higher concentration on the substrate side as described above, and in this case, adhesion between the substrate and the light-receiving layer can be further improved.

The above localized region (B) should desirably be provided within 5 $\mu$ from the interface position $t_B$, as explained in terms of the symbols indicated in FIGS. 16 through 24.

In the present invention, the above localized region (B) may be made the whole of the layer region ($L_T$) from the interface position $t_B$ to 5$\mu$ thickness or a part of the layer region ($L_T$).

It may suitably be determined depending on the characteristics required for the light-receiving layer to be formed whether the localized region (B) is made a part or the whole of the layer region ($L_T$).

The localized region (B) should preferably be formed to have a depth profile in the layer thickness direction such that the maximum value Cmax of the distribution concentration of the atoms (OCN) may preferably be 500 atomic ppm or more, more preferably 800 atomic ppm or more, most preferably 1000 atomic ppm or more.

In other words, the layer region (OCN) containing the atoms (OCN) should preferably be formed so that the maximum value Cmax of the distribution concentration C may exist within 5$\mu$ layer thickness from the substrate side (in the layer region with 5$\mu$ thickness from $t_B$).

When the layer region (OCN) is provided so as to occupy a part of the layer region of the light-receiving layer, the depth profile of the atoms (OCN) should desirably be formed so that the refractive index may be changed moderately at the interface between the layer region (OCN) and other layer regions.

By doing so, reflection of the light incident upon the light-receiving layer from the interface between contacted interfaces can be inhibited, whereby appearance of interference fringe pattern can more effectively be prevented.

It is also preferred that the distribution concentration C of the atoms (OCN) in the layer region (OCN) should be changed along a line which is changed continuously and moderately, in order to give smooth refractive index change.

In this regard, it is preferred that the atoms (OCN) should be contained in the layer region (OCN) so that the depth profiles as shown, for example, in FIGS. 16 through 19, FIG. 22 and FIG. 24 may be assumed.

In the present invention, formation of a photosensitive layer constituted of A-Si containing hydrogen atoms and/or halogen atoms (written as "A-Si(H,X)") may be conducted according to the vacuum deposition method utilizing discharging phenomenon, such as glow discharge method, sputtering method or ion-plating method. For example, for formation of a photosensitive layer constituted of A-Si(H,X) according to the glow discharge method, the basic procedure comprises introducing a starting material for Si supply capable of supplying silicon atoms, optionally together with a starting gase for introduction of hydrogen atoms (H) and/or a starting gas for introduction of halogen atoms (X), into a deposition chamber which can be brought internally to a reduced pressure and exciting glow discharge in said deposition chamber, thereby forming a layer comprising A-Si(H,X) on a desired substrate placed at a predetermined position. Alternatively, for formation according to the sputtering method, gases for introduction of hydrogen atoms (H) and/or halogen atoms (X), which may optionally be diluted with a diluting gas such as He, Ar, etc., may be introduced into a deposition chamber to form a desired gas plasma atmosphere when effecting sputtering of a target constituted of Si in an inert gas such as Ar, He, etc. or a gas mixture based on these gases.

In the case of the ion-plating method, for example, a vaporizing source such as a polycrystalline silicon or a single crystalline silicon may be placed as vaporizing source in a evaporating boat, and the vaporizing source is heated by the resistance heating method or the electron beam method (EB method) to be vaporized, and the flying vaporized product is permitted to pass through a desired gas plasma atmosphere, otherwise following the same procedure as in the case of sputtering.

The starting gas for supplying Si to be used in the present invention may include gaseous or gasifiable hydrogenated silicons (silanes) such as $SiH_4$, $Si_2H_6$, $Si_3H_8$, $Si_4H_{10}$ as effective materials. In particular, $SiH_4$ and $Si_2H_6$ are preferred with respect to easiness in handling during layer formation and high efficiency for supplying Si.

Effective starting gases for introduction of halogen atoms to be used in the present invention may include a large number of halogenic compounds, as exemplified preferably by halogenic gases, halides, interhalogen compounds, or gaseous or gasifiable halogenic compounds such as silane derivatives substituted with halogens. Further, there may also be included gaseous or gasifiable silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or iodine, interhalogen compounds such as BrF, ClF, $ClF_3$, $BrF_5$, $BrF_3$, $IF_3$, $IF_7$, ICl, IBr and the like.

As the silicon compounds containing halogen compound, namely so called silane derivatives substituted with halogens, there may preferably be employed silicon halides such as $SiF_4$, $Si_2F_6$, $SiCl_4$, $SiBr_4$ and the like.

When the characteristic light-receiving member of the present invention is formed according to the glow discharge method by employment of such a silicon compound containing halogen atoms, it is possible to form the photosensitive layer constituted of A-Si containing halogen atoms on a desired substrate without use of a hydrogenated silicon gas as the starting gas capable of supplying Si.

In the case of forming the photosensitive layer containing halogen atoms according to the glow discharge method, the basic procedure comprises, for example, silicon halide as the starting gas for Si supply and a gas such as Ar, $H_2$, He and the like, at a predetermined mixing ratio and gas flow rate into the deposition chamber for formation of the photosensitive layer and exciting glow discharge to form a plasma atmosphere of these gases, whereby the photosensitive layer can be formed on a desired substrate. In order to control the ratio of hydrogen atoms incorporated more easily, hydrogen gas, or a gas of a silicon compound containing hydrogen atoms may also be mixed with these gases in a desired amount to form the layer.

Also, each gas is not restricted to a single species, but multiple species may be available at any desired ratio. In either case of the sputtering method and the ion-plating method, introduction of halogen atoms into the layer formed may be performed by introducing the gas of the above halogen compound or the above silicon compound containing halogen atoms into the deposition chamber and forming a plasma atmosphere of said gas.

On the other hand, for introduction of hydrogen atoms, a starting gas for introduction of hydrogen atoms, for example, $H_2$ or the above gases such as silanes may be introduced into the deposition chamber for sputtering, followed by formation of the plasma atmosphere of said gases.

In the present invention, as the starting gas for introduction of halogen atoms, the halogen compounds or halo-containing silicon compounds as mentioned above can be effectively used. Otherwise, it is also possible to use effectively as the starting material for formation of the photosensitive layer gaseous or gasifiable substances, including hydrogen halides such as HF, HCl, HBr, HI and the like; halo-substituted hydrogenated silicon such as $SiH_2F_2$, $SiH_2I_2$, $SiH_2Cl_2$, $SiHCl_3$, $SiH_2Br_2$, $SiHBr_3$ and the like.

Among these substances, the halogen compounds containing hydrogen atoms can preferably be used as the starting material for introduction of halogens, because hydrogen atoms, which are very effective for controlling electrical or photoelectric characteristics, can be introduced into the layer simultaneously with introduction of halogen atoms during formation of the photosensitive layer.

For introducing the substance (C) for controlling conductivity, for example, the group III atoms or the group V atoms structurally into the charge injection preventive layer or the photosensitive layer constituting the light-receiving layer, the starting material for introduction of the group III atoms or the starting material for introduction of the group V atoms may be introduced under gaseous state into a deposition chamber together with other starting materials for formation of the light-receiving layer. As the material which can be used as such starting materials for introduction of the group III atoms or the group V atoms, there may be desirably employed those which are gaseous under the conditions of normal temperature and normal pressure, or at least readily gasifiable under layer forming conditions. Illustrative of such starting materials for introduction of the group III atoms are boron hydrides such as $B_2H_6$, $B_4H_{10}$, $B_5H_9$, $B_5H_{11}$, $B_6H_{10}$, $B_6H_{12}$, $B_6H_{14}$ and the like, boron halides such as $BF_3$, $BCl_3$, $BBr_3$ and the like, as the starting materials for introduction of boron atoms. In addition, there may also be included $AlCl_3$, $GaCl_3$, $Ga(CH_3)_3$, $InCl_3$, $TlCl_3$ and the like.

As the starting materials for introduction of the group V atoms, there are mentioned phosphorus hydrides such as $PH_3$, $P_2H_4$ and the like, phosphorus halides such as $PH_4I$, $PF_3$, $PF_5$, $PCl_3$, $PCl_5$, $PBr_3$, $PBr_5$, $PI_3$ and the like, as the starting materials for introduction of phosphorus atoms. In addition, there may also be included $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$ and the like, as effective materials for introduction of the group V atoms.

For provision of a layer region (OCN) containing the atoms (OCN) in the light-receiving layer, a starting material for introduction of the atoms (OCN) may be used together with the starting material for formation of the light-receiving layer during formation of the light-receiving layer and incorporated in the layer formed while controlling its amount.

When the glow discharge method is employed for formation of the layer region (OCN), a starting material for introduction of the atoms (OCN) is added to the material selected as desired from the starting materials for formation of the light-receiving layer as described above. For such a starting material for introduction of the atoms (OCN), there may be employed most of gaseous or gasified gasifiable substances containing at least the atoms (OCN) as the constituent atoms.

More specifically, there may be included, for example, oxygen ($O_2$), ozone ($O_3$), nitrogen monoxide (NO), nitrogen dioxide ($NO_2$), dinitrogen monoxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$); lower siloxanes containing silicon atom (Si), oxygen atom (O) and hydrogen atom (H) as constituent atoms, such as disiloxane ($H_3SiOSiH_3$), trisiloxane ($H_3SiOSiH_2OSiH_3$), and the like; saturated hydrocarbons having 1–5 carbon atoms such as methane ($CH_4$), ethane ($C_2H_6$), propane ($C_3H_8$), n-butane (n-$C_4H_{10}$), pentane ($C_5H_{12}$); ethylenic hydrocarbons having 2–5 carbon atoms such as ethylene ($C_2H_4$), propylene ($C_3H_6$), butene-1 ($C_4H_8$), butene-2 ($C_4H_8$), isobutylene ($C_4H_8$), pentene ($C_5H_{10}$); acetylenic hydrocarbons having 2–4 carbon atoms such as acetylene ($C_2H_2$), methyl acetyllene ($C_3H_4$), butyne ($C_4H_6$); and the like; nitrogen ($N_2$), ammonia ($NH_3$), hydrazine ($H_2NNH_2$), hydrogen azide ($HN_3$), ammonium azide ($NH_4N_3$), nitrogen trifluoride ($F_3N$), nitrogen tetrafluoride ($F_4N$) and so on.

In the case of the sputtering method, as the starting material for introduction of the atoms (OCN), there may also be employed solid starting materials such as $SiO_2$, $Si_3N_4$ and carbon black in addition to those gasifiable as enumerated for the glow discharge method. These can be used in the form of a target for sputtering together with the target of Si, etc.

When forming a layer region (OCN) containing the atoms (OCN) during formation of the light-receiving layer, formation of the layer region (OCN) having a desired depth profile in the direction of layer thickness formed by varying the distribution concentration C of the atoms (OCN) contained in said layer region (OCN) may be conducted in the case of glow discharge by introducing a starting gas for introduction of the atoms (OCN) the distribution concentration C of which is to be varied into a deposition chamber, while varying suitably its gas flow rate according to a desired change rate curve.

For example, by the manual method or any other method conventionally used such as an externally driven motor, etc., the opening of a certain needle valve provided in the course of the gas flow channel system may be gradually varied. During this operation, the rate of variation is not necessarily required to be linear, but the glow rate may be controlled according to a variation rate curve previously designed by means of, for example, a microcomputer to give a desired content curve.

When the layer region (OCN) is formed according to the sputtering method, formation of a desired depth profile of the atoms (OCN) in the layer thickness direction by varying the distribution concentration C of the atoms (OCN) may be performed first similarly as in the case of the glow discharge method by employing a starting material for introduction of the atoms (OCN) under gaseous state and varying suitably as desired the gas flow rate of said gas when introduced into the deposition chamber. Secondly, formation of such a depth profile can also be achieved by previously changing the composition of a target for sputtering. For example, when a target comprising a mixture of Si and $SiO_2$ is to be used, the mixing ratio of Si to $SiO_2$ may be varied in the direction of layer thickness of the target.

Figure 29:
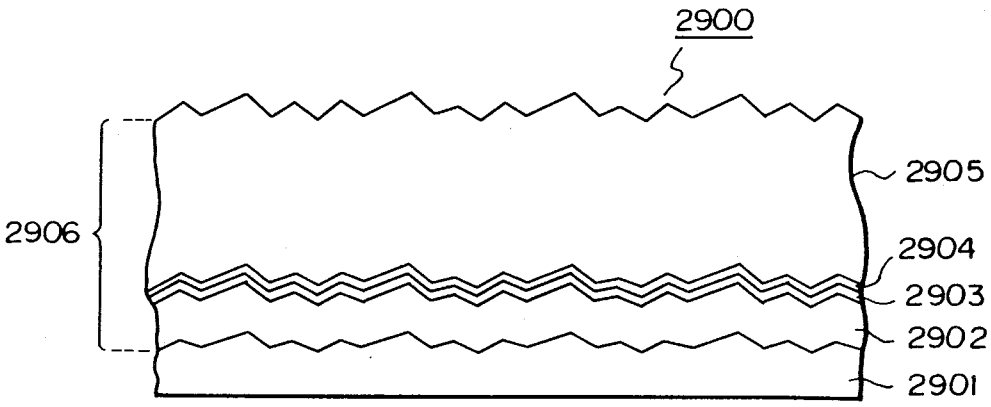

FIG. 29 shows another preferred embodiment of the present invention. The light-receiving member 2900 for electrophotography shown in FIG. 29 has a light-receiving layer with a multi-layer structure consisting of an electroconductive layer 2902, a barrier layer 2903, a charge generation layer 2904 and a charge transport layer 2905 on an electroconductive substrate 2901 having minute unevenness.

As the electroconductive layer 2902 as mentioned above, there may be employed, for example, a vapor deposited film of an electroconductive metal such as aluminum, tin or gold or a coated film containing electroconductive powder dispersed in a resin. The electroconductive powder employed may include metal powders such as aluminum, tin, silver and the like, carbon powder or electroconductive pigments composed primarily of metal oxides such as titanium oxide, barium sulfate, zinc oxide, tin oxide, and the like. Also, light absorbing agents may also be contained in the electroconductive layer 2902.

The resin for dispersing electroconductive pigment may any resin, provided that it satisfies the conditions of (1) firm adhesion to the substrate; (2) good dispersibility of powder and (3) satisfactory solvent resistance, but it is particularly preferred to employ a thermosetting resin such as curable rubber, polyurethane resin, epoxy resin, alkyd resin, polyester resin, silicone resin, acrylic-melamine resin and the like. The volume resistivity of the resin having electroconductive pigment dispersed therein should suitably be $10^{13}$ ohm.cm or less, preferably $10^{12}$ ohm.cm or less. For this purpose, the electroconductive pigment should preferably be contained at a proportion of 10 to 60% by weight in the coated film.

In the electroconductive layer 2902, a surface energy lowering agent such as silicone oils or various surfactants and the like can be contained, whereby a uniform coated surface with small coating defect can be obtained. As the method for dispersing electroconductive powder in a resin, there may be employed conventional methods by means of roll mill, ball mill, vibrating ball mill, attritor, sand mill, colloid mill, etc. When the substrate is in the form of a sheet, it is suitable to use wire var coating, blade coating, knife coating, roll coating, screen coating, etc. On the other hand, when the substrate is in the form of a cylinder, dip coating is suitable.

The electroconductive layer 2902 may be formed by coating to have a film thickness generally of 1 μm to 50 μm, preferably 5 μm to 30 μm, whereby the surface defect of the electroconductive substrate 1 can sufficiently be shielded in the case when the height of the projection 2 on the substrate is 100 μm or less.

Between the electroconductive layer 2902 and the charge generating layer 2904, there is provided a barrier layer 2903 having the barrier function exhibiting electrical barrier effect and the adhering function.

The barrier layer 2903 can be formed of casein, polyvinyl alcohol, nitrocellulose, ethylene-acryic acid copolymer, polyamide (nylon 6, nylon 66, nylon 610, copolymer nylon, alkoxymethylated nylon, etc.), polyurethane, gelatin, etc.

The barrier layer 2903 may have a thickness preferably of 0.1μ to 5μ, more preferably 0.5μ to 3μ.

The charge generation layer 2904 is formed by dispersing a charge generating substance, selected from azo pigments such as Sudan Red, Dian Blue, Janus Green B, etc.; quinone pigments such as Alcohol Yellow, Pyrene quinone, Indanthrene Brilliant Violet RRP, etc.; quinocyanine pigments; perylene pigments; indigo pigments such as indigo, thioindigo, etc.; bisbenzimidazole pigments such as Indofast Orange toner; phthalocyanine pigments such as copper phthaloxyanine, alumichlorophthalocyanine, etc.; quinacridone pigments and azulene compounds, in a binder resin such as polyester, polystyrene, polyvinyl butyral, polyvinyl pyrrolidone, methylcellulose, polyacrylates, cellulose ester, etc. Its thickness may preferably be 0.01μ to 1μ, more preferably 0.05μ to 0.5μ.

The charge transport layer 2905 is formed by dissolving a positive hole transportable substance such as compounds having, in the main chain or the side chain, polycyclic aromatic compounds such as anthracene, pyrene, phenanthrene, coronene and the like or nitrogen-containing cyclic compounds such as indole, carbazole, oxazole, isooxazole, thiazole, imidazole, pyrazole, oxadiazole, pyrazoline, thiadiazole, triazole and the like, hydrazone compounds, etc. in a film forming resin. This is because the charge transportable substance has generally a small molecular weight and is poor in film forming property. Such resins may include polycarbonate, polymethacrylates, polyallylate, polystyrene, polyester, polysulfone, styrene-acrylonitrile copolymer, styrene-methyl methacrylate copolymer and others.

The charge transport layer 2905 should preferably have a layer thickness of 5μ to 20μ. Also, it is possible to form a photosensitive layer having a structure with the charge generation layer 2904 laminated on the charge transport layer 2905.

The photosensitive layer is described above is not limited to those as described above, but it is also possible to use a charge migration complex comprising polyvinylcarbazole and trinitrofluorenone disclosed in IBM Journal of the Research and Development, p. 75–p. 89, January, 1971; photosensitive layers employing pyrilium compounds as disclosed in U.S. Pat. Nos. 4,315,983 and 4,327,169; photosensitive layers well known in the art containing inorganic photoconductive substances such as zinc oxide or cadmium sulfide dispersed in a resin; or photosensitive layers of vapor deposition type such as of selenium, selenium-tellurium, arsenic selenide and the like.

The present invention is described by referring to the following Examples.

EXAMPLE 1

In the Example, a semiconductor laser (wavelength: 780 nm) with a spot size of 80 μm was employed. Thus, on a cylindrical aluminum substrate [length (L) 357 mm, outer diameter (r) 80 mm] on which A-Si:H is to be deposited, a spiral groove was prepared by a lathe. The form of the groove is shown in FIG. 11 (B).

Figure 12:
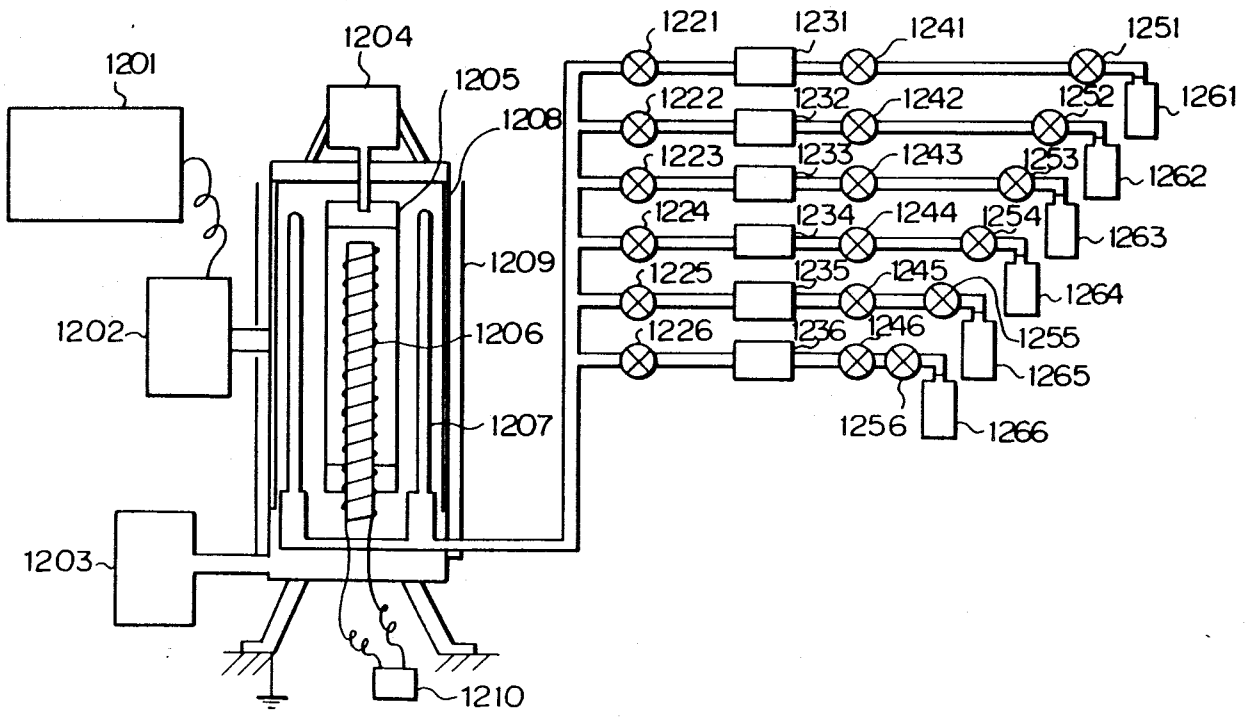
FIG. 12 is a schematic illustration of a deposition device for formation of light-receiving layer employed in Examples.

On this aluminum substrate, the charge injection preventive layer and the photosensitive layer were deposited by means of the device as shown in FIG. 12 in the following manner.

First, the constitution of the device is to be explained. 1201 is a high frequency power source, 1202 is a matching box, 1203 is a diffusion pump and a mechanical booster pump, 1204 is a motor for rotation of the aluminum substrate, 1205 is an aluminum substrate, 1206 is a heater for heating the aluminum substrate, 1207 is a gas inlet tube, 1208 is a cathode electrode for introduction of high frequency, 1209 is a shield plate, 1210 is a power source for heater, 1221 to 1226, 1241 to 1246 are valves, 1231 to 1236 are mass flow controllers, 1251 to 1256 are regulators, 1261 is a hydrogen ($H_2$) bomb, 1262 is a silane ($SiH_4$) bomb, 1263 is a diborone ($B_2H_6$) bomb, 1264 is a nitrogen oxide (NO) bomb and 1265 is a methane ($CH_4$) bomb and 1266 is an ammonia ($NH_3$) bomb.

Next, the preparation procedure is to be explained. All the main cocks of the bombs 1261–1266 are closed, all the mass flow controllers 1231–1236 and the valves 1221–1226 and 1241–1246 are opened and the deposition device was internally evacuated by the diffusion pump 1203 to $10^{-7}$ Torr. At the same time, the aluminum substrate 1205 was heated by the heater 1206 to 250 ° C. and maintained constantly at 250 ° C. After the aluminum substrate 1205 became constant at 250 ° C., the valves 1221–1226, 1241–1246 and 1251–1256 were closed, the main cocks of bombs 1261–1266 were opened and the diffusion pump 1203 was changed to the mechanical booster pump. The secondary pressure of the valves 1251–1256 equipped with regulators was set at 1.5 Kg/cm$^2$. The mass flow controller 1231 was set at 300 SCCM, and the valves 1241 and 1221 were successively opened to introduce $H_2$ gas into the deposition device.

Next, by setting the mass flow controller 1232 at 150 SCCM, $SiH_4$ gas in the bomb 1262 was introduced into the deposition device according to the same procedure as that in the introduction of $H_2$ gas. Then, by setting the mass flow controller 1233 so that $B_2H_6$ gas flow rate of the bomb 1263 may be 1600 Vol. ppm relative to $SiH_4$ gas flow rate, $B_2H_6$ gas was introduced into the deposition device according to the same procedure as that in the introduction of $H_2$ gas.

Next, the mass flow controller 1234 was set so that the initial value of the NO gas flow rate of the bomb 1264 might be 3.4 vol. % relative to $SiH_4$ gas flow rate to introduce NO gas into the deposition device according to the same operation as that in the introduction of $H_2$ gas.

And, when the inner pressure in the deposition device was stabilized at 0.2 Torr, the high frequency power source 1201 was turned on and glow discharge is generated between the aluminum substrate 1205 and the cathode electrode 1208 by controlling the mathcing box, and a A-Si:H:B:O layer (p-type A-Si:H layer containing B and O) was deposited to a thickness of 5 μm at a high frequency power of 160 W (a charge injection preventive layer). During this operation, NO gas flow rate was changed relative to $SiH_4$ gas flow rate as shown in FIG. 22, until NO gas rate became zero on completion of layer formation. After deposition of a 5 μm thick A-Si:H:B:O layer (p-type), inflow of $B_2H_6$ and NO was stopped by closing the valves 1223 and 1224 without discontinuing discharging.

And, A-Si:H layer (non-doped) with a thickness of 20 μm was deposited at a high frequency power of 150 W (a photosensitive layer). Then, with the high frequency power source being turned off and all the valves being closed, the deposition device was evacuated, the temperature of the aluminum substrate was lowered to room temperature and the substrate having formed the light-receiving layer thereon was taken out.

In this case, as shown in FIG. 11 (B) and (C), the surface of the substrate and the surface of the photosensitive layer were non-parallel to each other. In this case, the difference in average layer thickness between the center and the both ends of the aluminum substrate was 2 μm.

Figure 15:
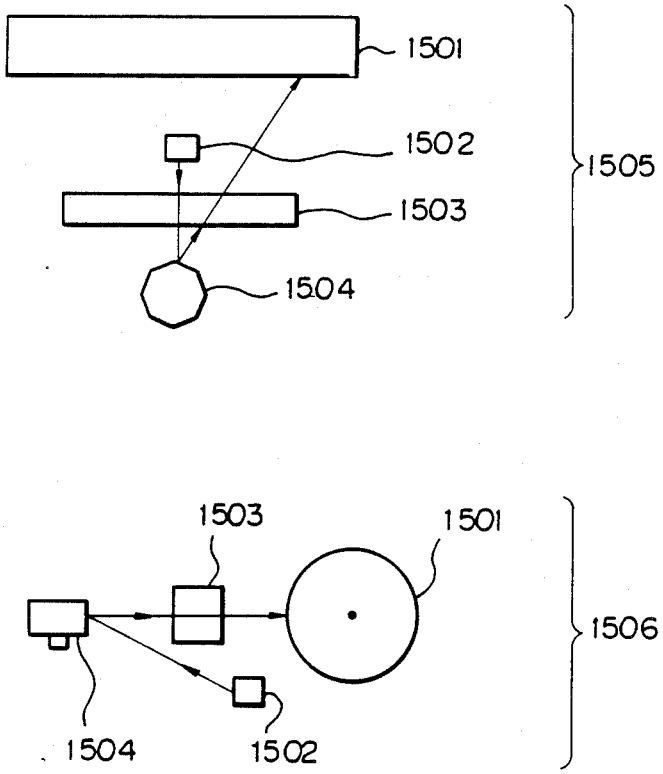
FIG. 15 is a schematic illustration of an image exposure device employed in Examples.

For the light-receiving member in this case, image exposure was effected by means of the device shown in FIG. 15 with a semiconductor laser of a wavelength 780 nm with a spot size of 80 μm, followed by developing and transfer to obtain an image.

In this case, no interference fringe pattern was observed and there could be obtained a member exhibiting practically satisfactory electrophotographic characteristics.

EXAMPLE 2

Figure 13:
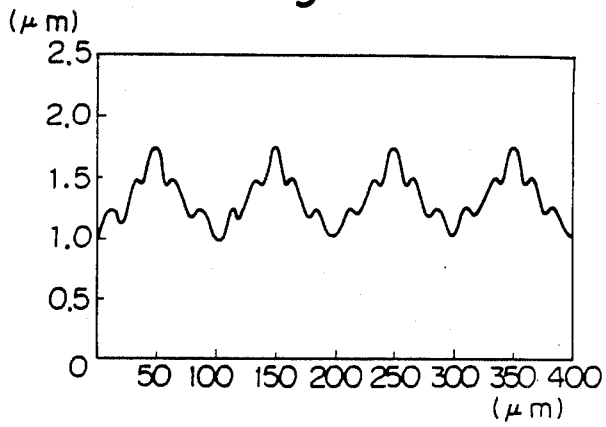
FIG. 13, FIG. 14, FIG. 30, FIG. 31 and FIG. 32 are structures of the light-receiving member prepared in Examples, respectively.
Figure 14:
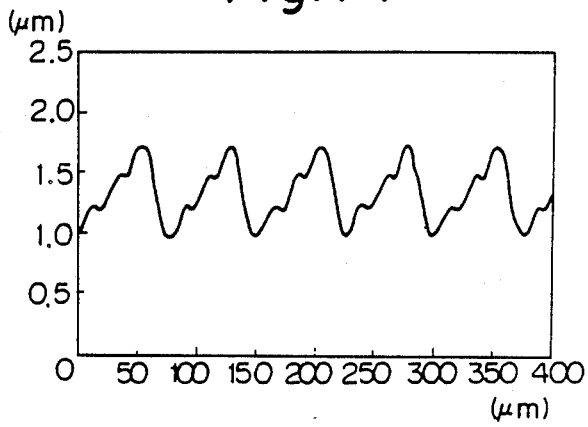

On cylindrical aluminum substrates having the surface characteristics as shown in FIG. 13 and FIG. 14, light-receiving members for electrophotography were formed under the conditions shown in Table 1A, following otherwise the same conditions and procedure as in Example 1. For these light-receiving members for electrophotography, by means of the same device as in Example 1, image exposure was effected, followed by developing, transfer and fixing, to obtain visible images on plain papers. These image forming processes were repeated successively for 100,000 times.

In this case, in the images obtained, no interference fringe pattern was observed to give practically satisfactory characteristics. Also, between the images at the initial stage and the image after copying 100,000 sheets, there was no difference observed at all, both being images of high quality.

EXAMPLE 3

On cylindrical aluminum substrates having the surface characteristics as shown in FIG. 13 and FIG. 14, light-receiving members for electrophotography were formed under the conditions shown in Table 2A, following otherwise the same conditions and procedure as in Example 1. For these light-receiving members for electrophotography, by means of the same device as in Example 1, image exposure was effected, followed by developing, transfer and fixing, to obtain visible images on plain papers.

In this case, in the images obtained, no interference fringe pattern was observed to give practically satisfactory characteristics.

EXAMPLE 4

On cylindrical aluminum substrates having the surface characteristics as shown in FIG. 13 and FIG. 14, light-receiving members for electrophotography were formed under the conditions shown in Table 3A, following otherwise the same conditions and procedure as in Example 1. For these light-receiving members for electrophotography, by means of the same device as in Example 1, image exposure was effected, followed by developing, transfer and fixing, to obtain visible images on plain papers.

In this case, in the images obtained, no interference fringe pattern was observed to give practically satisfactory characteristics.

EXAMPLE 5

On cylindrical aluminum substrates having the surface characteristics as shown in FIG. 13 and FIG. 14, light-receiving members for electrophotography were formed under the conditions shown in Table 4A, following otherwise the same conditions and procedure as in Example 1. For these light-receiving members for electrophotography, by means of the same device as in Example 1, image exposure was effected, followed by developing, transfer and fixing, to obtain visible images on plain papers.

In this case, in the images obtained, no interference fringe pattern was observed to give practically satisfactory characteristics.

EXAMPLE 6

Figure 25:
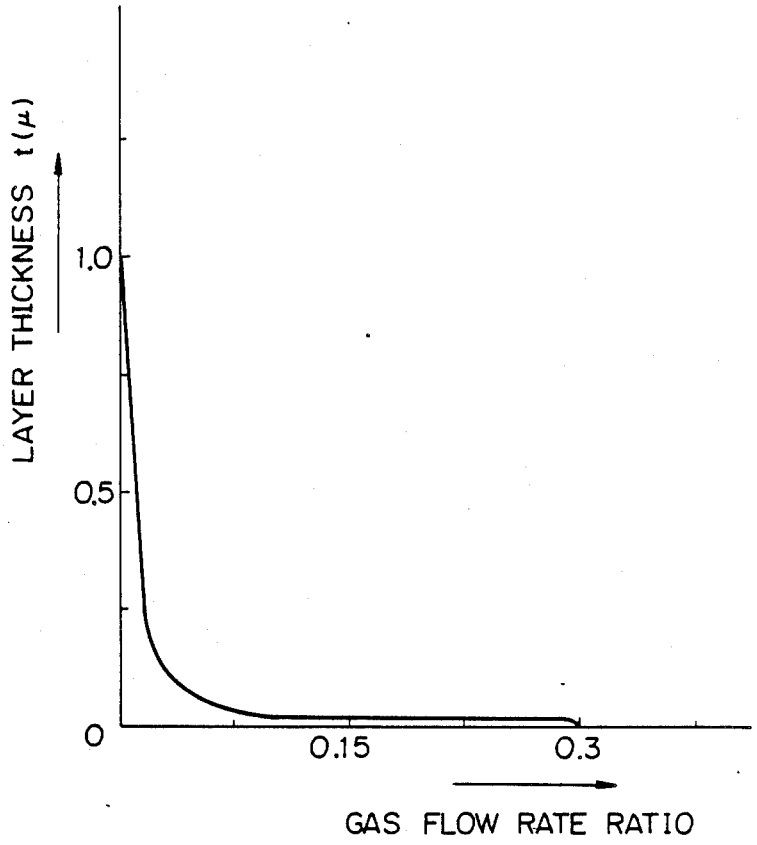
FIGS. 25 through 28 are each a schematic illustration showing the change rate curve of the gas flow rate ratio in Examples.

On cylindrical aluminum substrates having the surface characteristics as shown in FIG. 13 and FIG. 14, light-receiving members for electrophotography were formed under the conditions shown in Table 5A and according to the change rate curve of the gas flow rate ratio of NO to $SiH_4$ gas as shown in FIG. 25, following otherwise the same conditions and procedure as in Example 1. For these light-receiving members for electrophotography, by means of the same device as in Example 1, image exposure was effected, followed by developing, transfer and fixing, to obtain visible images on plain papers.

In this case, in the images obtained, no interference fringe pattern was observed to give practically satisfactory characteristics.

EXAMPLE 7

Figure 26:
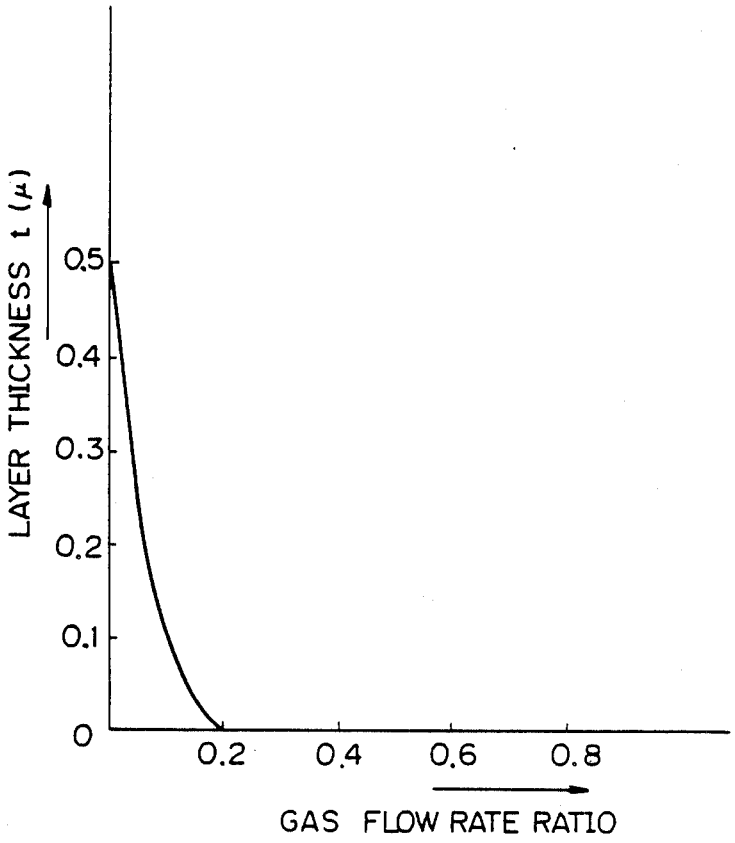

On cylindrical aluminum substrates having the surface characteristics as shown in FIG. 13 and FIG. 14, light-receiving members for electrophotography were formed under the conditions shown in Table 6A and according to the change rate curve of the gas flow rate ratio of NO to $SiH_4$ gas as shown in FIG. 26, following otherwise the same conditions and procedure as in Example 1. For these light-receiving members for electrophotography, by means of the same device as in Example 1, image exposure was effected, followed by developing, transfer and fixing, to obtain visible images on plain papers.

In this case, in the images obtained, no interference fringe pattern was observed to give practically satisfactory characteristics.

EXAMPLE 8

Figure 27:
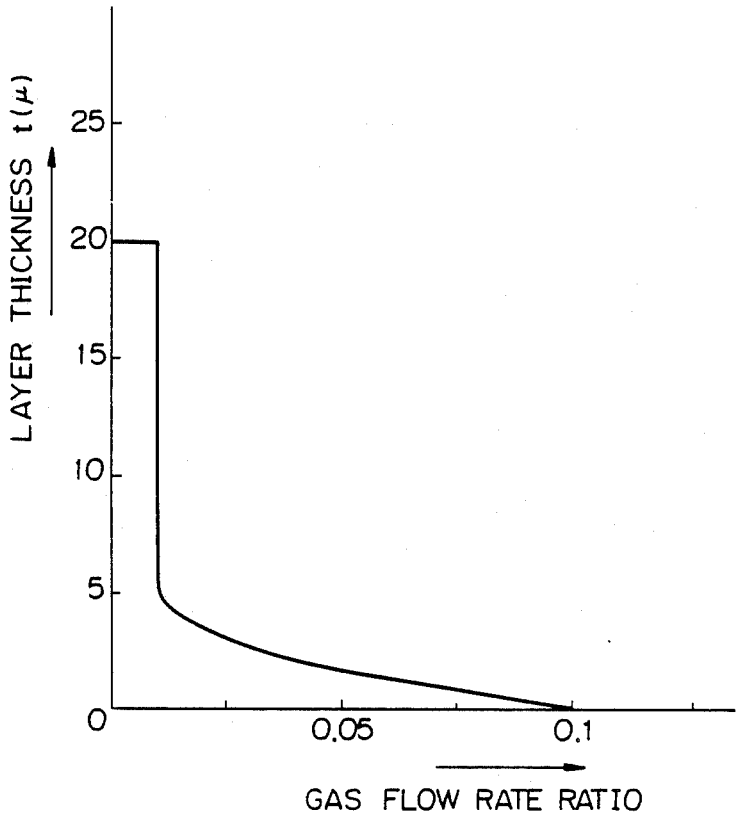

On cylindrical aluminum substrates having the surface characteristics as shown in FIG. 13 and FIG. 14, light-receiving members for electrophotography were formed under the conditions shown in Table 7A and according to the change rate curve of the gas flow rate ratio of NO to $SiH_4$ gas as shown in FIG. 27, following otherwise the same conditions and procedure as in Example 1. For these light-receiving members for electrophotography, by means of the same device as in Example 1, image exposure was effected, followed by developing, transfer and fixing, to obtain visible images on plain papers.

In this case, in the images obtained, no interference fringe pattern was observed to give practically satisfactory characteristics.

EXAMPLE 9

Figure 28:
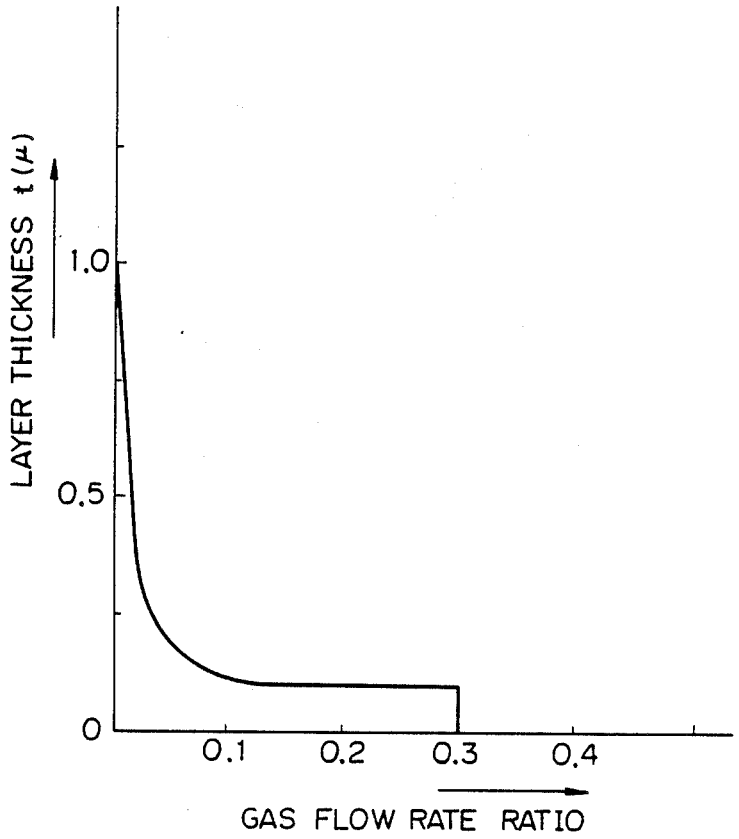

On cylindrical aluminum substrates having the surface characteristics as shown in FIG. 13 and FIG. 14, light-receiving members for electrophotography were formed under the conditions shown in Table 8A and according to the change rate curve of the gas flow rate ratio of NO to $SiH_4$ gas as shown in FIG. 28, following otherwise the same conditions and procedure as in Example 1. For these light-receiving members for electrophotography, by means of the same device as in Example 1, image exposure was effected, followed by developing, transfer and fixing, to obtain visible images on plain papers.

In this case, in the images obtained, no interference fringe pattern was observed to give practically satisfactory characteristics.

EXAMPLE 10

On cylindrical aluminum substrates having the surface characteristics as shown in FIG. 13 and FIG. 14, light-receiving members for electrophotography were formed under the conditions shown in Table 9A and according to the change rate curve of the gas flow rate ratio of NO to $SiH_4$ gas as shown in FIG. 28, following otherwise the same conditions and procedure as in Example 1. For these light-receiving members for electrophotography, by means of the same device as in Example 1, image exposure was effected, followed by developing, transfer and fixing, to obtain visible images on plain papers.

In this case, in the images obtained, no interference fringe pattern was observed to give practically satisfactory characteristics.

EXAMPLE 11

In this Example, a semiconductor laser (wavelength: 780 nm) with a spot size of 80 μm was employed. Thus, on a cylindrical aluminum substrate [length (L) 357 mm, outer diameter (r) 80 mm] on which A-Si:H is to be deposited, a spiral groove was prepared by a lathe. The form of the groove is shown in FIG. 11(B).

On this aluminum substrate, the charge injection preventive layer and the photosensitive layer were deposited by means of the device as shown in FIG. 12 in the following manner.

All of the main cocks of the bombs 1261–1266 are closed, all the mass flow controllers and the valves are opened and the deposition device was internally evacuated by the diffusion pump 1203 to $10^{-7}$ Torr. At the same time, the aluminum substrate 1205 was heated by the heater 1206 to 250° C. and maintained constantly at 250° C. After the aluminum substrate 1205 became constant at 250° C., the valves 1221–1226, 1241–1246 and 1251–1256 were closed, the main cocks of bombs 1261–1266 were opened and the diffusion pump 1203 was changed to the mechanical booster pump. The secondary pressure of the valves 1251–1256 equipped with regulators was set at 1.5 $Kg/cm^2$. The mass flow controller 1231 was set at 300 SCCM, and the valves 1241 and 1221 were successively opened to introduce $H_2$ gas into the deposition device.

Next, by setting the mass flow controller 1232 at 150 SCCM, $SiH_4$ gas in 1262 was introduced into the deposition device according to the same procedure as that in the introduction of $H_2$ gas. Then, by setting the mass flow controller 1233 so that $B_2H_6$ gas flow rate of the bomb 1263 may be 1600 Vol. ppm relative to $SiH_4$ gas flow rate, $B_2H_6$ gas was introduced into the deposition device according to the same procedure as that in the introduction of $H_2$ gas.

Next, the mass flow controller 1234 was set so that the NO gas flow rate of the bomb 1264 might be 3.4 vol. % relative to $SiH_4$ gas flow rate to introduce NO gas into the deposition device according to the same operation as that in the introduction of $H_2$ gas.

And, when the inner pressure in the deposition device was stabilized at 0.2 Torr, the high frequency power source 1201 was turned on and glow discharge is generated between the aluminum substrate 1205 and the cathode electrode 1208 by controlling the matching box 1202, and a A-Si:H:B layer (p-type A-Si:H layer containing B) was deposited to a thickness of 5 μm at a high frequency power of 150 W (a charge injection preventive layer). After deposition of a 5 μm thick A-Si:H:B layer (p-type), inflow of $B_2H_6$ was stopped by closing the valve 1223 without discontinuing discharging.

And, A-Si:H layer (non-doped) with a thickness of 20 μm was deposited at a high frequency power of 150 W (a photosensitive layer). Then, with the high frequency power source being turned off and all the valves being closed, the deposition device was evacuated, the temperature of the aluminum substrate was lowered to room temperature and the substrate having formed the light-receiving layer thereon was taken out. In this case, as shown in FIGS. 11(B) and (C), the surface of the substrate and the surface of the photosensitive layer were non-parallel to each other. In this case, the difference in average layer thickness between the center and the both ends of the aluminum substrate was 2 μm.

For the light-receiving member for electrophotography as described above, image exposure was effected by means of the device shown in FIG. 15 with a semiconductor laser of a wavelength 780 nm with a spot size of 80 μm, followed by developing and transfer to obtain an image. In this case, no interference fringe pattern was observed and there could be obtained a member exhibiting practically satisfactory electrophotographic characteristics.

EXAMPLE 12

Figure 30:
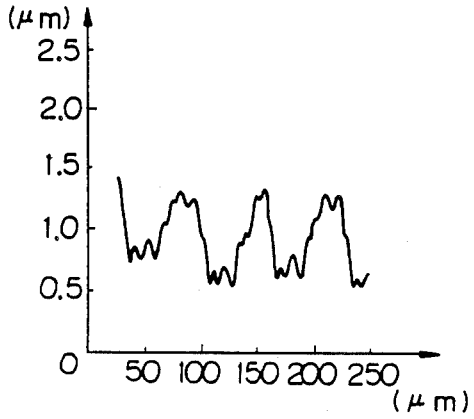
Figure 31:
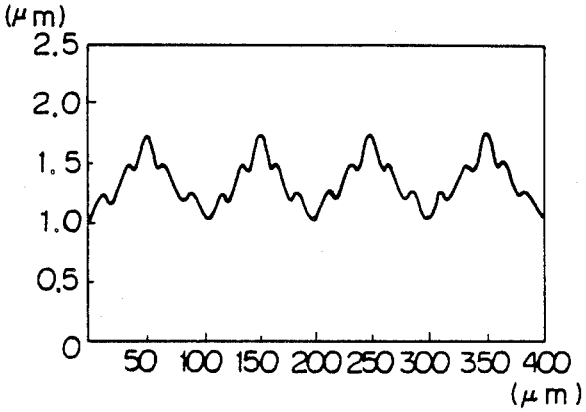
Figure 32:
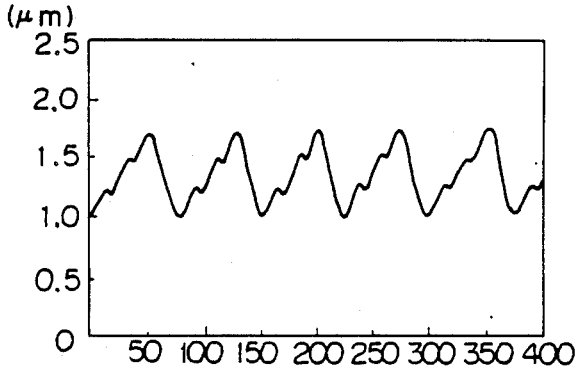

On cylindrical aluminum substrates having the surface characteristics as shown in FIG. 30, FIG. 31 and FIG. 32, light-receiving members for electrophotography were formed under the conditions shown in Table 1B.

For these light-receiving members for electrophotography, by means of the same device as in Example 11, image exposure was effected, followed by developing, transfer and fixing, to obtain visible images on plain papers. In this case, in the images obtained, no interference fringe pattern was observed to give practically satisfactory characteristics.

EXAMPLE 13

On cylindrical aluminum substrates having the surface characteristics as shown in FIG. 30, FIG. 31 and FIG. 32, light-receiving members for electrophotography were formed under the conditions shown in Table 2B.

For these light-receiving members for electrophotography, by means of the same device as in Example 11, image exposure was effected, followed by developing, transfer and fixing, to obtain visible images on plain papers. In this case, in the images obtained, no interference fringe pattern was observed to give practically satisfactory characteristics.

EXAMPLE 14

On cylindrical aluminum substrates having the surface characteristics as shown in FIG. 30, FIG. 31 and FIG. 32, light-receiving members for electrophotography were formed under the conditions shown in Table 3B.

For these light-receiving members for electrophotography, by means of the same device as in Example 11, image exposure was effected, followed by developing, transfer and fixing, to obtain visible images on plain papers. These image forming processes were repeated successively for 100,000 times. In this case, in all the images obtained, no interference fringe pattern was observed to give practically satisfactory characteristics. Also, between the images at the initial stage and the image after copying 100,000 sheets, there was no difference observed at all, both being images of high quality.

EXAMPLE 15

On cylindrical aluminum substrates having the surface characteristics as shown in FIG. 30, FIG. 31 and FIG. 32, light-receiving members for electrophotography were formed under the conditions shown in Table 4B.

For these light-receiving members for electrophotography, by means of the same device as in Example 11, image exposure was effected, followed by developing, transfer and fixing, to obtain visible images on plain papers. In this case, in the images obtained, no interference fringe pattern was observed to give practically satisfactory characteristics.

EXAMPLE 16

In this Example, a semiconductor laser (wavelength: 780 nm) with a spot size of 80 μm was employed. Thus, on a cylindrical aluminum substrate [length (L) 357 mm, outer diameter (r) 80 mm] on which A-Si:H is to be deposited, a spiral groove was prepared by a lathe. The sectional form of the groove is shown in FIG. 11(B).

On this aluminum substrate, the charge injection preventive layer and the photosensitive layer were deposited by means of the device as shown in FIG. 12 in the following manner.

All the main cocks of the bombs 1261–1266 are closed, all the mass flow controllers and the valves are opened and the deposition device was internally evacuated by the diffusion pump 1203 to $10^{-7}$ Torr. At the same time, the aluminum substrate 1205 was heated by the heater 1206 to 250° C. and maintained constantly at 250° C. After the aluminum substrate 1205 became constantly at 250° C., the valves 1221–1226, 1241–1246 and 1251–1256 were closed, the main cocks of bombs 1261–1266 were opened and the diffusion pump 1203 was changed to the mechanical booster pump. The secondary pressure of the valves 1251–1256 equipped with regulators was set at 1.5 Kg/cm$^2$. The mass flow controller 1231 was set at 300 SCCM, and the valves 1241 and 1221 were successively opened to introduce $H_2$ gas into the deposition device.

Next, by setting the mass flow controller 1232 at 150 SCCM, $SiH_4$ gas in 1261 was introduced into the deposition device according to the same procedure as that in the introduction of $H_2$ gas. Then, by setting the mass flow controller 1233 so that $B_2H_6$ gas flow rate of the bomb 1263 may be 1600 Vol. ppm relative to $SiH_4$ gas flow rate, $B_2H_6$ gas was introduced into the deposition device according to the same procedure as that in the introduction of $H_2$ gas.

And, when the inner pressure in the deposition device was stabilized at 0.2 Torr, the high frequency power source 1201 was turned on and glow discharge is generated between the aluminum substrate 1205 and the cathode electrode 1208 by controlling the matching box 1202, and a A-Si:H:B layer (p-type A-Si:H layer containing B) was deposited to a thickness of 5 μm at a high frequency power of 150 W (a charge injection preventive layer). After deposition of a 5 μm thick A-Si:H:B layer (p-type), inflow of $B_2H_6$ was stopped by closing the valve 1223 without discontinuing discharging.

And, A-Si:H layer (non-doped) with a thickness of 20 μm was deposited at a high frequency power of 150 W (a photosensitive layer). Then, with the high frequency power source 1201 being turned off and all the valves being closed, the deposition device was evacuated, the temperature of the aluminum substrate lowered to room temperature and the substrate having formed the light-receiving layer thereon was taken out. In this case, as shown in FIGS. 11(B) and (C), the surface of the substrate and the surface of the photosensitive layer were non-parallel to each other. In this case, the difference in average layer thickness between the center and the both ends of the aluminum substrate was 2 μm.

For the light-receiving member for electrophotography as described above, image exposure was effected by means of the device shown in FIG. 15 with a semiconductor laser of a wavelength 780 nm with a spot size of 80 μm, followed by developing and transfer to obtain an image.

In this case, no interference fringe pattern was observed and there could be obtained a member exhibiting practically satisfactory electrophotographic characteristics.

EXAMPLE 17

The surface of a cylindrical aluminum substrate was worked with a lathe as shown in FIG. 30.

On this cylindrical aluminum substrate, a light-receiving member for electrophotography of a-Si:H was prepared in the same manner as described in Example 16.

The light-receiving member for electrophotography was subjected to image exposure by means of the device as shown in FIG. 15, followed by developing and transfer to obtain an image. The transferred image was found to have practically satisfactory characteristics with no fringe pattern being observed.

EXAMPLE 18

On cylindrical aluminum substrate having the surface characteristics as shown in FIG. 31 and FIG. 32, light-receiving members for electrophotography were formed under the conditions shown in Table 1C.

For these light-receiving members for electrophotography, by means of the same device as in Example 16, image exposure was effected, followed by developing, transfer and fixing, to obtain visible images on plain papers. These image forming processes were repeated successively for 100,000 times. In this case, in all the images obtained, no interference fringe pattern was observed to give practically satisfactory characteristics. Also, between the images at the initial stage and the image after copying 100,000 sheets, there was no difference observed at all, both being images of high quality.

EXAMPLE 19

On cylindrical aluminum substrates having the surface characteristics as shown in FIG. 31 and FIG. 32, light-receiving members for electrophotography were formed under the conditions shown in Table 2C. For these light-receiving members for electrophotography, by means of the same device as in Example 16, image exposure was effected, followed by developing, transfer and fixing, to obtain visible images on plain papers.

In this case, in the images obtained, no interference fringe pattern was observed to give practically satisfactory characteristics.

EXAMPLE 20

On cylindrical aluminum substrates having the surface characteristics as shown in FIG. 31 and FIG. 32, light-receiving members for electrophotography were formed under the conditions shown in Table 3C. For these light-receiving members for electrophotography, by means of the same device as in Example 16, image exposure was effected, followed by developing, transfer and fixing, to obtain visible images on plain papers.

In this case, in the images obtained, no interference fringe pattern was observed to give practically satisfactory characteristics.

EXAMPLE 21

On cylindrical aluminum substrates having the surface characteristics as shown in FIG. 31 and FIG. 32, light-receiving members for electrophotography were formed under the conditions shown in Table 4C. For these light-receiving members for electrophotography, by means of the same device as in Example 16, image exposure was effected, followed by developing, transfer and fixing, to obtain visible images on plain papers.

In this case, in the images obtained, no interference fringe pattern was observed to give practically satisfactory characteristics.

EXAMPLE 22

Cylindrical aluminum substrates of 60 mm in diameter and 258 mm in length were worked to the surface characteristics as shown in FIG. 31 and FIG. 32.

Next, 25 parts by weight of titanium oxide (ECT-62) produced by Titanium Kogyo K.K., 25 parts by weight of titanium oxide (SR-1T) produced by Sakai Kogyo K.K. and a phenol resin (Plyofen J325) produced by Dainippon Ink K.K. were dissolved in 500 parts by weight of methanol and methyl cellosolve (methanol/methyl cellosolve=4 parts by weight/15 parts by weight) and, after stirring, dispersed together with 50 parts by weight of glass beads of 1 mm in diameter for 10 hours.

To the dispersion was added a silicone oil (SH 289 A) produced by Toshiba Silicone K.K. in an amount of 50 ppm as the solid and the mixture was stirred to prepare a coating solution for formation of an electroconductive layer.

The coating solution for formation of electroconductive layer was applied by dipping on the cylindrical aluminum surface subjected to cutting working as described above to a film thickness after drying of 20 μm, followed by drying by heating at 140° C. for 30 minutes, to form an electroconductive layer.

Subsequently, 10 parts by weight of a copolymerized nylon resin (trade nade: Amilan CM-8000, produced by Toray K.K.) were dissolved in a mixture comprising 60 parts by weight of methanol and 40 parts by weight of butanol, and applied by dipping on the above electroconductive layer to provide a polyamide resin layer of 1 μ in thickness thereon.

Next, 1 part by weight of ε-type copper phthalocyanine (Lionol blue ES, produced by Toyo Ink K.K.), 1 part by weight of a butyral resin (Ethlec BM-2, produced by Sekisui Kagaku K.K.) and 10 parts by weight of cyclohexanone were dispersed in a sand mill dispersing machine containing 1 mm ϕ glass beads for 20 hours, and thereafter the resultant dispersion was diluted with 20 parts by weight of methyl ethyl ketone. The dispersion was applied on the polyamide resin layer previously formed by dipping and dried to form a charge generation layer. The film thickness was found to be 0.3μ.

Then, 10 parts by weight of a hydrazone compound having the formula:

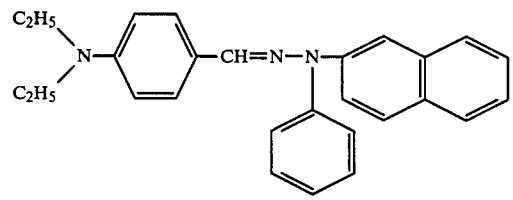

and 15 parts by weight of a styrene-methyl methacrylate copolymer resin (trade name: MS 200, produced by Seitetsu Kagaku K.K.) were dissolved in 80 parts by weight of toluene. The solution was applied on the above charge generation layer and dried by hot air at 100° C. for one hour to form a charge transport layer with a thickness of 16μ.

The light-receiving member for electrophotography thus formed was mounted in Canon laser beam printer LBP-CX (produced by Canon, Inc.) which is an electrophotographic system printer of reversal developing system equipped with a semiconductor laser with an oscillating wavelength of 778 nm, and line scanning was performed all over the surface to form an image in which the whole surface became a black image. As the result, no interference fringe pattern was found to appear at all in the whole black image.

Next, the operation of forming letters as the image by line scanning of the laser beam according to letter signals was repeated for 2000 times under the conditions of a temperature of 15° C. and a relative humidity of 10%, and the copied image of the 2000th sheet was taken out. When black speckles having a size of 0.2 mm or more in diameter (black dots) were counted, no black speckle was found at all.

EXAMPLE 23

Ten grams of fine particulate zinc oxide (Sazax 2000, produced by Sakai Kagaku K.K.), 4 g of an acrylic resin (Dianal LR 009, produced by Mitsubishi Rayon K.K.), 10 g of toluene and 10 mg of an azlenium compound represented by the formula shown below were mixed thoroughly in a ball mill to prepare a coating solution for a photosensitive layer.

Azlenium compound

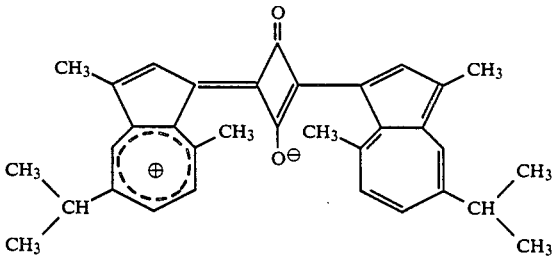

Except for providing a photosensitive layer by use of this coating solution to a thickness of 21 μm in place of a photosensitive layer with a laminated structure comprising the charge generation layer and the charge transport layer as employed in Example 22, a light-receiving member for electrophotography was prepared in the same manner as in Example 22. The light-receiving member was mounted in the laser beam printer as employed in Example 22 (but the charger was changed so that the charging might be effected to positive polarity), followed by similar measurement. As the result, no interference infringe pattern was found in the whole black image surface, and yet no black speckle of 0.2 mm in diameter or larger was found at all. Thus, the image obtained was found to be a very good image.

EXAMPLE 24

The cylindrical aluminum substrate subjected to cutting working in Example 22 was oxidized anodically in a conventional manner to form a thin film of aluminum oxide thereon, and an arsenic selenide layer (tellurium: 10 wt. %) was formed to a layer thickness of 15 μm according to the vapor deposition method.

The light-receiving member for electrophotography was mounted in the laser beam printer as employed in Example 23, and the same measurements were performed to obtain similar results.

TABLE 1A

| Layer | Starting gas | Flow rate (SCCM) | High frequency power (W) | Layer thickness (μm) |
|---|---|---|---|---|
| Charge injection preventive layer | $H_2$ | 300 | 160 | 3 |
| | $SiH_4$ | 150 | | |
| | $NH_3$ | 30 | | |
| | $B_2H_6$ | 0.24 | | |
| Photosensitive layer | $H_2$ | 300 | 300 | 20 |
| | $SiH_4$ | 300 | | |

TABLE 2A

| Layer | Starting gas | Flow rate (SCCM) | High frequency power (W) | Layer thickness (μm) |
|---|---|---|---|---|
| Charge injection preventive layer | $H_2$ | 300 | 160 | 5 |
| | $SiH_4$ | 150 | | |
| | $NH_3$ | 15 | | |
| | $B_2H_6$ | 0.3 | | |
| Photosensitive Layer | $H_2$ | 300 | 200 | 20 |
| | $SiH_4$ | 300 | | |

TABLE 3A

| Layer | Starting gas | Flow rate (SCCM) | High frequency power (W) | Layer thickness (μm) |
|---|---|---|---|---|
| Charge injection preventive layer | $H_2$ | 300 | 170 | 2.8 |
| | $SiH_4$ | 150 | | |
| | $CH_4$ | 15 | | |
| | $B_2H_6$ | 0.45 | | |
| Photosensitive Layer | $H_2$ | 300 | 200 | 21 |
| | $SiH_4$ | 300 | | |

TABLE 4A

| Layer | Starting gas | Flow rate (SCCM) | High frequency power (W) | Layer thickness (μm) |
|---|---|---|---|---|
| Charge injection preventive layer | $H_2$ | 300 | 170 | 5.1 |
| | $SiH_4$ | 160 | | |
| | $CH_4$ | 16 | | |
| | $B_2H_6$ | 0.4 | | |
| Photosensitive Layer | $H_2$ | 300 | 230 | 22 |
| | $SiH_4$ | 300 | | |

TABLE 5A

| Layer constitution | Gases employed | Flow rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>NO | $SiH_4 = 50$ | $NO/SiH_4 = 3/10 \sim 0$ | 150 | 12 | 1 |
| Second layer | $SiH_4/He = 0.05$ | $SiH_4 = 50$ | | 150 | 12 | 20 |

TABLE 6A

| Layer constitution | Gases employed | Flow rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>$B_2H_6/He = 10^{-3}$<br>NO | $SiH_4 = 50$ | $B_2H_6/SiH_4 = 4 \times 10^{-3}$<br>$NO/SiH_4 = 2/10 \sim 0$ | 150 | 12 | 0.5 |
| Second layer | $SiH_4/He = 0.05$ | $SiH_4 = 50$ | | 150 | 12 | 20 |

TABLE 7A

| Layer constitution | Gases employed | Flow rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>$B_2H_6/He = 10^{-3}$<br>NO | $SiH_4 = 50$ | $B_2H_6/SiH_4 = 2 \times 10^{-4}$<br>$NO/SiH_4 = 1/10 \sim 1/100$ | 160 | 14 | 5 |
| Second layer | $SiH_4/He = 0.05$<br>NO | $SiH_4 = 50$ | $NO/SiH_4 = 1/100$ | 160 | 14 | 15 |

TABLE 8A

| Layer constitution | Gases employed | Flow rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>$B_2H_6/He = 10^{-3}$<br>NO | $SiH_4 = 50$ | $B_2H_6/SiH_4$<br>$2 \times 10^{-4}$<br>$NO/SiH_4 =$<br>3/10~0 | 160 | 14 | 1.0 |
| Second layer | $SiH_4/He = 0.05$<br>$B_2H_6/He = 10^{-3}$ | $SiH_4 = 50$ | $B_2H_6/SiH_4 =$<br>$2 \times 10^{-4}$ | 160 | 12 | 15 |

TABLE 9A

| Layer constitution | Gases employed | Flow rate (SCCM) | Flow rate ratio | Discharging power (W) | Layer formation rate (Å/sec) | Layer thickness (μ) |
|---|---|---|---|---|---|---|
| First layer | $SiH_4/He = 0.05$<br>$PH_3/He = 10^{-3}$<br>NO | $SiH_4 = 50$ | $PH_3/SiH_4 =$<br>$3 \times 10^{-4}$<br>$NO/SiH_4 =$<br>3/10~0 | 170 | 15 | 1 |
| Second layer | $SiH_4/He = 0.05$ | $SiH_4 = 50$ | | 170 | 15 | 20 |

TABLE 1B

| Layer | Starting gas | Flow rate (SCCM) | High frequency power (W) | Layer thickness (μm) |
|---|---|---|---|---|
| Charge injection preventive layer | $H_2$ | 300 | 160 | 3 |
| | $SiH_4$ | 150 | | |
| | $NH_3$ | 30 | | |
| | $B_2H_6$ | 0.24 | | |
| Photosensitive Layer | $H_2$ | 300 | 300 | 20 |
| | $SiH_4$ | 300 | | |

TABLE 3B

| Layer | Starting gas | Flow rate (SCCM) | High frequency power (W) | Layer thickness (μm) |
|---|---|---|---|---|
| Charge injection preventive layer | $H_2$ | 300 | 170 | 2.8 |
| | $SiH_4$ | 150 | | |
| | $CH_4$ | 15 | | |
| | $B_2H_6$ | 0.45 | | |
| Photosensitive Layer | $H_2$ | 300 | 200 | 21 |
| | $SiH_4$ | 300 | | |

TABLE 2B

| Layer | Starting gas | Flow rate (SCCM) | High frequency power (W) | Layer thickness (μm) |
|---|---|---|---|---|
| Charge injection preventive layer | $H_2$ | 300 | 160 | 5 |
| | $SiH_4$ | 150 | | |
| | $NH_3$ | 15 | | |
| | $B_2H_6$ | 0.3 | | |
| Photosensitive Layer | $H_2$ | 300 | 200 | 20 |
| | $SiH_4$ | 300 | | |

TABLE 4B

| Layer | Starting gas | Flow rate (SCCM) | High frequency power (W) | Layer thickness (μm) |
|---|---|---|---|---|
| Charge injection preventive layer | $H_2$ | 300 | 170 | 5.1 |
| | $SiH_4$ | 160 | | |
| | $CH_4$ | 16 | | |
| | $B_2H_6$ | 0.4 | | |
| Photosensitive layer | $H_2$ | 300 | 230 | 22 |
| | $SiH_4$ | 300 | | |

TABLE 1C

| Layer constitution | Gases employed | Flow rate (SCCM) | Flow rate ratio | Discharging power (W) | Layer formation rate (Å/sec) | Layer thickness (μm) |
|---|---|---|---|---|---|---|
| Charge injection preventive layer | $SiH_4$<br>$B_2H_6/H_2$<br>(= 3000 ppm)<br>NO | 300 | $B_2H_6/SiH_4 =$<br>1600 ppm<br>$NO/SiH_4 =$<br>3.4% | 150 | 10 | 5 |
| Photosensitive layer | $SiH_4$<br>$H_2$ | 300<br>300 | $SiH_4/H_2 = 1$ | 300 | 20 | 20 |

TABLE 2C

| Layer constitution | Gases employed | Flow rate (SCCM) | Flow rate ratio | Discharging power (W) | Layer formation rate (Å/sec) | Layer thickness (μm) |
|---|---|---|---|---|---|---|
| Charge injection preventive layer | $SiH_4$<br>NO | 50<br>60 | $SiH_4/NO =$<br>5/6 | 100 | 3 | 0.2 |
| Photosensitive layer | $SiH_4$<br>$H_2$ | 300<br>300 | $SiH_4/H_2 = 1$ | 300 | 20 | 20 |

TABLE 3C

| Layer constitution | Gases employed | Flow rate (SCCM) | Flow rate ratio | Discharging power (W) | Layer formation rate (Å/sec) | Layer thickness (μm) |
|---|---|---|---|---|---|---|
| Charge injection | $SiH_4$ | 30 | $SiH_4/NH_3 =$ | 200 | 3 | 0.2 |

TABLE 3C-continued

| Layer constitution | Gases employed | Flow rate (SCCM) | Flow rate ratio | Discharging power (W) | Layer formation rate (Å/sec) | Layer thickness (μm) |
|---|---|---|---|---|---|---|
| preventive layer | $NH_3$ | 200 | 3/20 | | | |
| Photosensitive layer | $SiH_4$ | 300 | $SiH_4/H_2 = 1$ | 300 | 20 | 20 |
| | $H_2$ | 300 | | | | |

TABLE 4C

| Layer constitution | Gases employed | Flow rate (SCCM) | Flow rate ratio | Discharging power (W) | Layer formation rate (Å/sec) | Layer thickness (μm) |
|---|---|---|---|---|---|---|
| Charge injection preventive layer | $SiH_4$ | 30 | $SiH_4/CH_4$ = 1/20 | 300 | 3 | 0.3 |
| | $CH_4$ | 600 | | | | |
| Photosensitive layer | $SiH_4$ | 300 | $SiH_4H_2 = 1$ | 300 | 20 | 20 |
| | $H_2$ | 300 | | | | |

What is claimed is:

1. A substrate for light-receiving members, having a large number of protruding portions on a surface thereof, each of said protruding portions having at a predetermined cut position a sectional shape comprising a main projection and a subprojection, the main projection and the subprojection overlapping each other.

2. A light-receiving member comprising a substrate having a large number of protruding portions on a surface thereof, each of said protruding portions having at a predetermined cut position a sectional shape comprising a main projection and a subprojection, the main projection and the subprojection overlapping each other, and a light-receiving layer at least a part of the layer region of which has photosensitivity.

3. A light-receiving member comprising a substrate having a large number of protruding portions on a surface thereof, each of said protruding portions having at a predetermined cut position a sectional shape comprising a main projection and a subprojection, the main projection and the subprojection overlapping each other, and a light-receiving layer comprising an amorphous material containing silicon atoms at least a part of the layer region of which has photosensitivity.

4. An electrophotographic system comprising a light-receiving member comprising a substrate having a large number of protruding portions on a surface thereof, each of said protruding portions having at a predetermined cut position a sectional shape comprising a main projection and a subprojection, the main projection and the subprojection overlapping each other, and a light-receiving layer at least a part of the layer region of which has photosensitivity.

5. An electrophotographic system comprising a light-receiving member comprising a substrate having a large number of protruding portions on a surface thereof, each of said protruding portions having at a predetermined cut position a sectional shape comprising a main projection and a subprojection, the main projection and the subprojection overlapping each other, and a light-receiving layer comprising an amorphous material containing silicon atoms at least a part of the layer region of which has photosensitivity.

6. The invention according to claim 2 or 4, wherein said layer region has photoconductivity.

7. The invention according to claim 2 or 4, wherein said layer region comprises an amorphous material containing silicon atoms.

8. The invention according to claim 2 or 4, wherein said layer region comprises an organic photoconductive material.

9. The invention according to claim 2 or 4, wherein said light-receiving layer has a multi-layer structure.

10. The invention according to claim 2 or 4, wherein the light-receiving layer has a charge injection preventive layer as one of its constituent layers.

11. The invention according to claim 2 or 4, wherein the light-receiving layer has a charge injection preventive layer, and a photosensitive layer in the order from the substrate side.

12. The invention according to claim 2 or 4, wherein the light-receiving layer comprises an amorphous material comprising silicon atoms and at least one of hydrogen atoms and halogen atoms.

13. The invention according to claim 10, wherein the charge injection preventive layer contains a substance (C) for controlling conductivity.

14. The invention according to claim 13, wherein the substance (C) for controlling conductivity is an atom belonging to the gruop III or the group V of the periodic table.

15. The invention according to claim 13, wherein the content of the substance (C) for controlling conductivity in the charge injection preventive layer is 0.001 to $5\times10^4$ atomic ppm.

16. The invention according to claim 10, wherein the charge injection preventive layer has a layer thickness of 30 Å to 10μ.

17. The invention according to claim 11, wherein the charge injection preventive layer contains a substance (C) for controlling conductivity.

18. The invention according to claim 17, wherein the substance (C) for controlling conductivity is an atom belonging to the group III or the group V of the periodic table.

19. The invention according to claim 17, wherein the content of the substance (C) for controlling conductivity in the charge injection preventive layer is 0.001 to $5\times10^4$ atomic ppm.

20. The invention according to claim 11, wherein the charge injection preventive layer has a layer thickness of 30 Å to 10μ.

21. The invention according to claim 11, wherein the photosensitive layer comprises an amorphous material comprising silicon atoms and at least one of hydrogen atoms and halogen atoms.

22. The invention according to claim 11, wherein the photosensitive layer has a layer thickness of 1 to 100μ.

23. The invention according to claim 2 or 4, wherein the light-receiving layer has a barrier layer as one of the constituent layers.

24. The invention according to claim 23, wherein the barrier layer comprises an insulating material.

25. The invention according to claim 12, wherein the light-receiving layer contains at least one kind of atoms selected from oxygen atoms, carbon atoms and nitrogen atoms.

26. The invention according to claim 2 or 4, wherein the light-receiving layer has an electroconductive layer, a barrier layer, a charge generation layer and a charge transport layer from the substrate side.

27. The invention according to claim 1, 2, 3, 4 or 5, wherein said protruding portions are arranged regularly.

28. The invention according to claim 1, 2, 3, 4 or 5, wherein said protruding portions are arranged in 15 cycles.

29. The invention according to claim 1, 2, 3, 4 or 5, wherein each of said protruding portions has the same shape as the first order approximation.

30. The invention according to claim 1, 2, 3, 4 or 5, wherein said protruding portions have a plurality of subprojections.

31. The invention according to claim 1, 2, 3, 4 or 5, wherein said sectional shape of said protruding portion is symmetrical with the main projection as its center.

32. The invention according to claim 1, 2, 3, 4 or 5, wherein said sectional shape of said protruding portion is asymmetrical with the main projection as its center.

33. The invention according to claim 1, 2, 3, 4 or 5, wherein said protruding portion is formed by mechanical working.

34. The invention according to claim 3 or 5, wherein the light-receiving layer contains at least one kind of atoms selected from oxygen atoms, carbon atoms and nitrogen atoms in uniform distribution state in the layer thickness direction.

35. The invention according to claim 3 or 5, wherein the light-receiving layer contains at least one kind of atoms selected from oxygen atoms, carbcn atoms and nitrogen atoms in nonuniform distribution state in the layer thickness direction.

36. The invention according to claim 35, wherein said nonuniform distribution state is such that the depth profile has a portion in which the concentration is decreased toward the free surface side of the light-receiving layer.

37. The invention according to claim 35, wherein said nonuniform distribution state is such that the depth profile has a portion in which the concentration is increased toward the substrate side.

38. The invention according to claim 35, in which said nonuniform distribution state is such that the maximum distribution concentration is possessed in the layer region at the end portion on the substrate side of said light-receiving layer.

39. The invention according to claim 3 or 5, wherein a substance (C) for controlling conductivity is contained in the light-receiving layer.

40. The invention according to claim 39, wherein the substance (C) for controlling conductivity is an atom belonging to the group III or the group V of the periodic table.

41. The invention according to claim 39, wherein the substance (C) for controlling conductivity is an atom selected from among B, Al, Ga, In, Tl, P, As, Sb and Bi.

42. The invention according to claim 3 or 5, wherein the light-receiving layer has a layer region (PN) containing a substance for controlling conductivity.

43. The invention according to claim 42, wherein the distribution state of the substance for controlling conductivity in the layer region (PN) is uniform in the layer thickness direction.

44. The invention according to claim 42, wherein the substance for controlling conductivity is an atom belonging to the group III or the group V of the periodic table.

45. The invention according to claim 42, wherein the layer region (PN) is provided at the end portion on the substrate side of the light-receiving layer.

46. The invention according to claim 42, wherein the layer region (PN) occupies a part of the layer region in the light-receiving layer.

47. The invention according to claim 46, wherein the content of the substance for controlling conductivity in the layer region (PN) is 0.01 to $5\times10^4$ atomic ppm.

48. The invention according to claim 3 or 5, wherein at least one of hydrogen atoms and halogen atoms are contained in the light-receiving layer.

49. The invention according to claim 3 or 5, wherein 0.01 to 40 atomic % of hydrogen atoms are contained in the light-receiving layer.

50. The invention according to claim 3 or 5, wherein 0.01 to 40 atomic % of halogen atoms are contained in the light-receiving layer.

51. The invention according to claim 3 or 5, wherein 0.01 to 40 atomic % as a total of hydrogen atoms and halogen atoms are contained in the light-receiving layer.

52. The invention according to claim 2, 3, 4 or 5, wherein the light-receiving layer region (OCN) containing at least one kind of atoms selected from oxygen atoms, nitrogen atoms and carbon atoms.

53. The invention according to claim 52, wherein the layer region (OCN) is provided at the end portion on the substrate side of the light-receiving layer.

54. The invention according to claim 53, wherein the layer region (OCN) contains 0.001 to 50 atomic % of oxygen atoms.

55. The invention according to claim 53, wherein the layer region (OCN) contains 0.001 to 50 atomic % of carbon atoms.

56. The invention according to claim 53, wherein the layer region (OCN) contains 0.001 to 50 atomic % of nitrogen atoms.

57. The invention according to claim 53, wherein oxygen atoms are contained in the layer region (OCN) in nonuniform distribution state in the layer thickness direction.

58. The invention according to claim 53, wherein oxygen atoms are contained in the layer region (OCN) in uniform distribution state in the layer thickness direction.

59. The invention according to claim 53, wherein carbon atoms are contained in the layer region (OCN) in nonuniform distribution state in the layer thickness direction.

60. The invention according to claim 53, wherein carbon atoms are contained in the layer region (OCN) in uniform distribution state in the layer thickness direction.

61. The invention according to claim 53, wherein nitrogen atoms are contained in the layer region (OCN)

in nonuniform distribution state in the layer thickness direction.

62. The invention according to claim 53, wherein nitrogen atoms are contained in the layer region (OCN) in uniform distribution state in the layer thickness direction.

63. The invention according to claim 3 or 5, wherein the light-receiving layer has a layer thickness of 1 to 100μ.

64. An electrophotographic image forming process comprising:

(a) applying a charging treatment to the light receiving member of claim 2 or 3;

(b) irradiating the light receiving member with a laser beam carrying information to form an electrostatic latent image; and (c) developing said electrostatic latent image.

* * * * *

UNITED STATES PATENT AND TRADEMARK OFFICE

CERTIFICATE OF CORRECTION

PATENT NO. : 4,705,733

DATED : November 10, 1987

INVENTOR(S) : KEISHI SAITOH, ET AL.

It is certified that error appears in the above-identified patent and that said Letters Patent is hereby corrected as shown below:

AT [56] IN THE REFERENCES

Foreign Patent Documents,
insert --

| | | | |
|---|---|---|---|
| 1346711 | 2/1963 | France | 430/69 |
| 60-31144 | 2/1985 | Japan | 430/69--. |

COLUMN 6

Line 61, "$1<L$," should read --$1 \leqslant l$,--.

COLUMN 29

Line 12, "infringe" should read --fringe--.

COLUMN 33

Table 4C, line 16, "$SiH_4H_2 = 1$" should read --$SiH_4/H_2 = 1$--.

COLUMN 34

Line 40, "gruop III" should read --group III--.

COLUMN 35

Line 14, "claim" should read --claims--.
Line 17, "claim" should read --claims--.
Line 20, "claim" should read --claims--.
Line 23, "claim" should read --claims--.
Line 26, "claim" should read --claims--.

UNITED STATES PATENT AND TRADEMARK OFFICE

CERTIFICATE OF CORRECTION

PATENT NO. : 4,705,733

DATED : November 10, 1987

INVENTOR(S) : KEISHI SAITOH, ET AL.

It is certified that error appears in the above-identified patent and that said Letters Patent is hereby corrected as shown below:

COLUMN 35 (continued)

Line 29, "claim" should read --claims--.
Line 32, "claim" should read --claims--.
Line 42, "carbcn" should read --carbon--.

COLUMN 36

Line 34, "claim" should read --claims--.
Line 35, "layer region" should read --layer has a layer region--.

Signed and Sealed this

Ninth Day of August, 1988

*Attest:*

*Attesting Officer*

DONALD J. QUIGG

*Commissioner of Patents and Trademarks*